US006340278B1

(12) United States Patent
Takeda

(10) Patent No.: US 6,340,278 B1
(45) **Date of Patent: *Jan. 22, 2002**

(54) GRANULE TRANSFER APPARATUS AND GRANULE SPREADING METHOD

(75) Inventor: Mitsuo Takeda, Aizuwakamatsu (JP)

(73) Assignee: Kabuki Construction Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/297,267

(22) PCT Filed: Aug. 31, 1998

(86) PCT No.: PCT/JP98/03881

§ 371 Date: May 14, 1999

§ 102(e) Date: May 14, 1999

(87) PCT Pub. No.: WO99/11887

PCT Pub. Date: Mar. 11, 1999

(30) Foreign Application Priority Data

Aug. 29, 1997 (JP) ..... 9-249734

(51) Int. Cl.[7] ..... B66C 23/00

(52) U.S. Cl. ..... 414/140.9; 414/140.8; 198/588; 198/594

(58) Field of Search ..... 414/140.9, 140.8, 414/142.2; 198/594, 588

(56) References Cited

U.S. PATENT DOCUMENTS

| | | | | |
|---|---|---|---|---|
| 4,519,768 A | | 5/1985 | Murai et al. | |
| 4,712,962 A | * | 12/1987 | Johnston | 414/144 |
| 4,925,010 A | * | 5/1990 | Pallasvirta | 198/588 |
| 5,193,964 A | * | 3/1993 | Soros | 414/140.9 |
| 5,234,094 A | * | 8/1993 | Weyermann et al. | 198/303 |
| 5,807,059 A | | 9/1998 | Takeda | |

FOREIGN PATENT DOCUMENTS

| | | |
|---|---|---|
| FR | 596489 A | 10/1925 |
| FR | 1 005 403 A | 4/1952 |
| JP | 8-209937 | 8/1996 |

* cited by examiner

*Primary Examiner*—Christopher P. Ellis
*Assistant Examiner*—Khoi H. Tran
(74) *Attorney, Agent, or Firm*—Staas & Halsey LLP

(57) ABSTRACT

A stage (3) for holding a boom body (4), which is composed of a plurality of boom components (15, 41, 42), is mounted on a tower mast (2) so as to be turnable by means of a servomotor. A servomotor (56, 61) for turning the next boom component is provided on the distal end of each boom component. Each boom component is provided with a belt conveyor, and granule that is pulled up from the ground to the position of the stage (3) by means of a bucket (5) is transported by means of the conveyor and thrown out from a boom body end (66). As this is done, the respective turns of the stage 3 and each boom component are controlled in accordance with the rotation of the servomotor, and the boom body end (66) is controlled, whereby the granule can be thrown out into any desired position within a operable range.

19 Claims, 13 Drawing Sheets

GRANULE TRANSFER APPARATUS AND GRANULE SPREADING METHOD

TECHNICAL FIELD

The present invention relates to an improvement of a granule transfer apparatus and a granule spreading method, used to transport and place fresh concrete for dams, building structures, etc., transport and spread mortar, or transport and spread earth and sand for reclamation.

BACKGROUND ART

A transfer apparatus for fresh concrete or the like, which comprises a tower mast, a stage, a boom body formed of two or more boom components, etc., is a generally known apparatus described in an international application (WO96/16242) that is subjected to international publication, for example.

Referring now to FIG. 17, there will be described an outline of this conventional concrete transfer apparatus.

A tower mast TM contains therein a vessel-shaped carrier CV for pulling up fresh concrete F (concrete not hardened) from a concrete plant or the like onto an elevator body portion EL through the space under the tower mast TM. The vessel-shaped carrier CV is pulled up by means of a lift winch 171 with the aid of a wire rope 170. The lift winch 171 is fixed to a stage body portion 172 that constitutes the elevator body portion EL.

Supported on the stage body portion 172 is a boom body portion, which is formed of a first boom component C' and a second boom component C".

The fresh concrete, pulled up to the upper part of the tower mast TM by means of the vessel-shaped carrier CV, is fed onto a conveyor for fresh concrete transportation (belt conveyor G'), which is provided on the first boom component C' on the stage body portion 172, via fresh concrete delivery means 173 and 173'.

The proximal end of the second boom component C" is connected to the distal end of the first boom component C', and these boom components C' and C" are arranged continuous with each other, in front and in rear, on a straight line. The first boom component C' is provided with pulleys 174 and 175 on its opposite ends, individually, and the first belt conveyor G' is stretched between the pulleys 174 and 175. The first belt conveyor G' is driven by a belt conveyor drive motor 176 that is placed on the first boom component C'. The second boom component C" is provided with pulleys 177 and 178 on its opposite ends, individually, and a second belt conveyor G" is stretched between the pulleys 177 and 178. The second belt conveyor G" is driven by a belt conveyor drive motor 179 that is placed on the second boom component C".

The fresh concrete F, which is fed onto the first belt conveyor G' via the fresh concrete delivery means 173 and 173', is transported away from the stage body portion 172 by the first belt conveyor G' and delivered onto the second belt conveyor G". The fresh concrete on the second belt conveyor G" is further transported away from the first belt conveyor G' and dropped onto the ground through the distal end of the second belt conveyor G".

An upper lift frame 180 is fixed to the stage body portion 172, while a lower lift frame 182 is fixed to a mast frame 181 of the tower mast TM. A hydraulic cylinder 183 is interposed between the upper and lower lift frames 180 and 182 so that the upper lift frame 180 or the stage body portion 172 can be lifted or lowered with respect to the lower lift frame 182 or the tower mast TM.

The first boom component C' can be turned on a substantially horizontal plane with respect to the stage body portion 172 by means of a boom turning device 184. Further, the drawn-up length of the second boom component C" from the first boom component C' is adjustable so that the overall transportation length that combines the first and second belt conveyors G' and G" can be changed. Accordingly, the point on which the fresh concrete drops through the distal end of the second belt conveyor G" is settled depending on the angle of turn of the first boom component C' (and second boom component C") with respect to the stage body portion 72 and the drawn-up length of the second boom component C" from the first boom component C'.

If the drawn-up length of the second boom component C" from the first boom component C' is reduced, however, the position of the distal end of the second belt conveyor G", from which the fresh concrete drops, gets nearer to the tower mast TM, but, it never gets beyond the position of the distal end of the first boom component C' as it approaches the tower mast TM. Thus, the fresh concrete cannot be dropped on any region near the tower mast TM by only making a combination of the first and second boom components C' and C" turnable on a substantially horizontal plane with respect to the stage body portion 172 and making the substantial length of the combination of the first and second boom components C' and C" changeable.

To solve this problem, a tripper device H is provided on the first boom component C' so as to be movable with respect to the first boom component C'. The tripper device H enables the fresh concrete, delivered thereto by means of the first belt conveyor G' on the first boom component C', to be taken out sideways and dropped on the way. If the tripper device H is situated on the distal end of the first boom component C', the fresh concrete delivered thereto by means of the first belt conveyor G' is fed onto the second belt conveyor G" on the second boom component C" without being taken out sideways. Accordingly, the point on which the fresh concrete drops from the tripper device H is settled depending on the angle of turn of the first boom component C' with respect to the stage body portion 172 and the position of the tripper device H on the first boom component C'.

Thus, the conventional fresh concrete transfer apparatus shown in FIG. 17 has the following problems.

(1) Since the first and second boom components C' and C" turn on the horizontal plane with respect to the stage body portion 172 in a manner such that they are arranged continuous with each other, in front and in rear, on a straight line. It is necessary, therefore, to secure a wide area around the tower mast TM that is free from obstacles.

(2) The fresh concrete can be dropped in zigzags onto the ground by gradually moving in the distal end of the second boom component C" in the dropping position or the tripper device H on the first boom component C' in a certain direction while alternatingly turning the stage body portion 172 itself that is fitted with the first and second boom components C' and C". However, the heavyweight structure that includes the first and second boom components C' and C" and the stage body portion 172 has a great inertial mass, so that there is a problem on response when its movement is controlled for fine operation, in particular.

(3) Further, the structure in which the second boom component C" is connected to the distal end of the first boom component C' in a straight line requires the structure of the second boom component C" to be designed for lighter weight. Accordingly, the second boom component C" or the junction between the first and second boom components C' and C" is liable to suffer a problem in rigidity.

In order to solve this problem, the boom on the distal end side (second boom component C") may be suspended from the tower mast TM in a manner such that one and the other ends of a suspension rope are fixed to the boom on the distal end side and the upper part of the tower mast TM, respectively. Since the boom components are contractible as mentioned before, however, the length of the suspension rope cannot be fixed. It is necessary, therefore, to change the length of the suspension rope as the boom is extended or contracted or give up attaching the suspension rope itself. Inevitably, the former arrangement requires use of a winch or other equipment that entails a complicated construction. If the attachment of the suspension rope is given up, on the other hand, the problem on rigidity cannot be solved.

(4) Further, the connected boom components are restricted in number by the aforesaid structural problem. Practically, the number of connectable boom components is limited to two (first and second boom components C' and C") , as shown in FIG. 17. In the case where the combined boom in its minimum-length state is not very short and if the transfer apparatus is located in a narrow space, the mobility of the apparatus is restricted substantially.

(4) In the case where the combined boom body is supported on the tower mast that is built on the ground, moreover, the fresh concrete or the like can be spread and placed only in the region around the tower mast.

DISCLOSURE OF THE INVENTION

The object of the present invention is to provide a granule transfer apparatus and a granule spreading method utilizing the granule transfer apparatus, which eliminate the aforementioned drawbacks of the prior art, and in which granule can be spread around a boom body supporting portion, such as a tower mast, without use of a tripper device, the granule can be spread without shifting the location of the boom body supporting portion such as the tower mast even in case there are any obstacles between a target position for spreading operation and the boom body supporting portion such as the tower mast, weaving operation can be smoothly effected in various directions, the rigidity of a boom component on the distal end side and its junction can be secured satisfactorily, and a boom body can be designed so that its minimum-state length is shorter than that for the conventional apparatus.

Further, the boom body supporting portion is attached to a traveling body, such as a vehicle or vessel, so that a granule spreading region can be selected freely.

In order to achieve the above object, a granule transfer apparatus according to the present invention is a granule transfer apparatus that comprises a boom body formed of two or more connected boom components each including transfer means for transferring granule, a boom body supporting portion for rotatably mounting a stage having the boom body, stage turning means for turning the stage relatively to the boom body supporting portion, and granule delivery means provided on the stage and serving to deliver the granule to the transfer means of the boom component situated nearest to the stage. The granule transfer apparatus further comprises a pivotal portion located between the two connected boom components and serving to connect the basal part of the next boom component to the distal end portion of the boom component on the stage side, boom turning means for turning the next boom component with respect to the stage-side boom component, and junction granule delivery means for delivering the granule from the transfer means of the stage-side boom component to the transfer means of the next boom component.

In an aspect of a granule spreading method according to the present invention using one such granule transfer apparatus, an operational movement program to order the position of the boom body end and a rectilinear or arcuate movement between positions is previously taught, and the controller is caused to drive the transfer means to move the boom body end along a movement path given by the taught program and spread the granule while throwing out the granule through the boom body end, in accordance with the taught program.

In another aspect of the granule spreading method, the control means is previously caused to set and store a movement pattern for the boom body end, a granule spreading region is set as an input in the control means to move the boom body end into the granule spreading region, and the transfer means is then driven to move the boom body end in the set granule spreading region, thereby automatically spreading the granule, in accordance with the set movement pattern, while the granule is being thrown out through the boom body end.

According to the granule transfer apparatus of the present invention and the granule spreading method using this granule transfer apparatus, fixed-position rotation of the stage and turning motion of each boom component are combined so that the granule can be spread all over the peripheral region of the boom component supporting portion (tower mast and traveling body), so that boom components need not be provided with a tripper device thereon. Thus, the construction of the granule transfer apparatus is simplified, so that the general manufacturing cost is reduced. As the weight is reduced, moreover, the rigidity and strength of the boom body are improved relatively.

Moreover, the angle of turn of the stage and the angle of turn of each boom component can be adjusted without changing the target spreading position for the granule. If there are any obstacles between the boom body supporting portion, such as the tower mast, and the target spreading position, therefore, the granule spreading operation can be carried out without making any large-scale rearrangement, such as relocation of the boom body supporting portion such as the tower mast.

Further, tamping operation based on weaving can be carried out with only the boom component in the leading position rocked bit by bit. Therefore, the tamping operation can be effected more quickly and smoothly than in the case of the conventional apparatus in which the weaving operation is performed by continuously extending and contracting the continuous boom body on a straight line or by alternatingly turning the stage bit by bit. Since the granule can be automatically spread over the set granule spreading region in accordance with the taught pattern, the tamping operation can be carried out easily. Furthermore, the granule can be automatically spread along a taught granule spreading path.

Since the substantial lengths of the boom components are subject to no change, moreover, the strength of each boom component and its pivotal portion can be secured with use of a very simple structure including a suspension rope, mast, etc., and the rigidity of the whole boom body can be improved. Furthermore, the rigidity can be secured without increasing the weight or complicating the construction. If the same rigidity of the boom body as in the conventional case is required ultimately, therefore, the boom body can be dividedly composed of more boom components and can be designed so that its minimum-state length is shorter than that for the conventional apparatus.

Figure 1A:
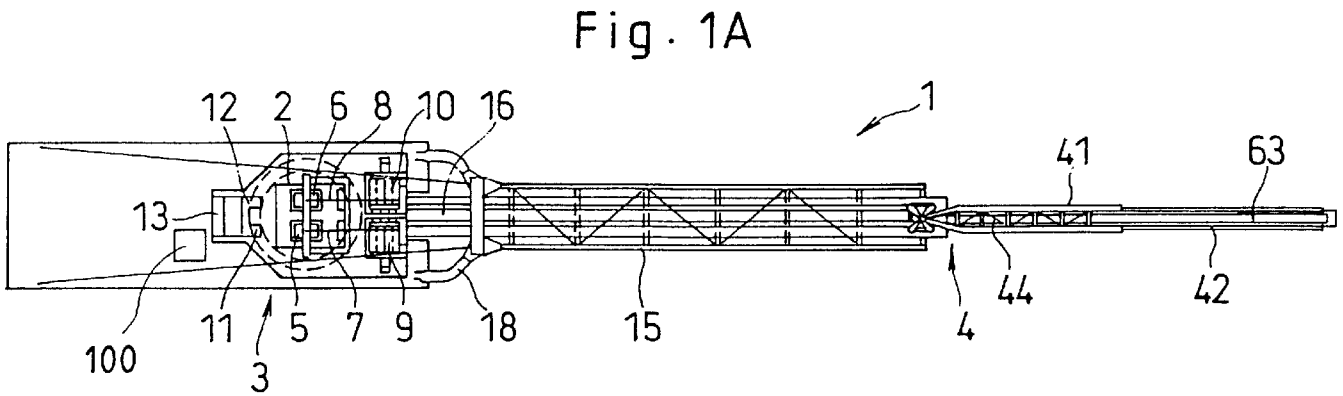
FIG. 1A is a plan view of a granule transfer apparatus according to a first embodiment of the present invention.

BEST MODE FOR CARRYING OUT THE INVENTION (Granule transfer apparatus according to first embodiment)

A granule transfer apparatus according to a first embodiment of the present invention will be described with reference to FIG. 1A (plan view) and FIG. 1B (side view).

A granule transfer apparatus 1 generally comprises a tower mast 2 (that constitutes a boom body supporting portion), a stage 3, and a boom body 4. The tower mast 2 is formed of a prism-shaped steel-frame structure, and has therein granule transfer means, i.e., a bucket elevator, for heaving up fresh concrete, mortar, or earth and sand (those substances to be transported will hereinafter be referred to generically as "granule") from a concrete plant or the like onto the stage 3.

Transportation buckets 5 and 6, which constitute the bucket elevator, are vertically driven by winches 9 and 10 with the aid of wires 7 and 8, respectively, and reciprocate between the basal part of the tower mast 2 and the stage 3, thereby lifting the granule, delivered from a cart (not shown) in the concrete plant at the basal part of the tower mast 2, to the height of the stage 3.

The transportation buckets 5 and 6, which has been moved to the stage 3, discharge the granule into chutes 11 and 12, whereupon the granule is delivered to granule transfer means of a first boom component 15, i.e., a belt conveyor 16 (FIG. 2B), which is situated nearest to the stage 3, through a screw feeder 13 with a hopper, for use as granule delivery means, and a pressure-feed path 14.

Numeral 17 denotes a counterweight, and 18 denotes a truss structure for maintaining the rigidity of the first boom component 15. The stage 3, which is mounted on a stage base 19, can be finely adjusted in vertical position by extending or contracting a plurality of hydraulic cylinders 20 attached to a supporter 21 that is fixed to the tower mast 2. Numeral 100 denotes a controller for controlling the granule transfer apparatus.

The above-described apparatus is constructed in the same manner as conventional granule transfer apparatuses (e.g., fresh concrete transfer apparatus disclosed in Japanese Patent Application KOKAI No. 8-209937 mentioned before).

Referring now to FIGS. 3 to 7, there will be described a turning mechanism for the stage 3.

Figure 3:
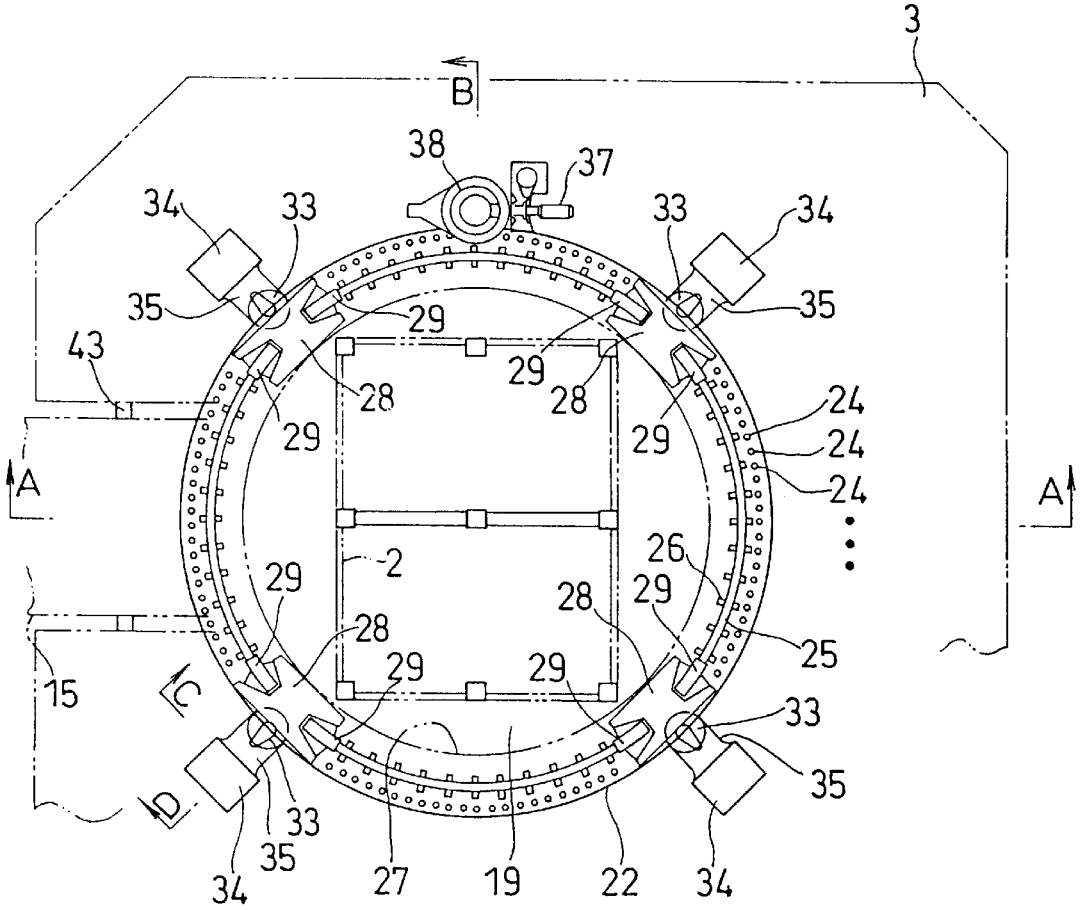
FIG. 3 is a view (partially in section) of the granule transfer apparatus of FIGS. 1A and 1B, showing the engagement between a tower mast, stage, and stage base and taken from above the top side of the stage.
Figure 4:
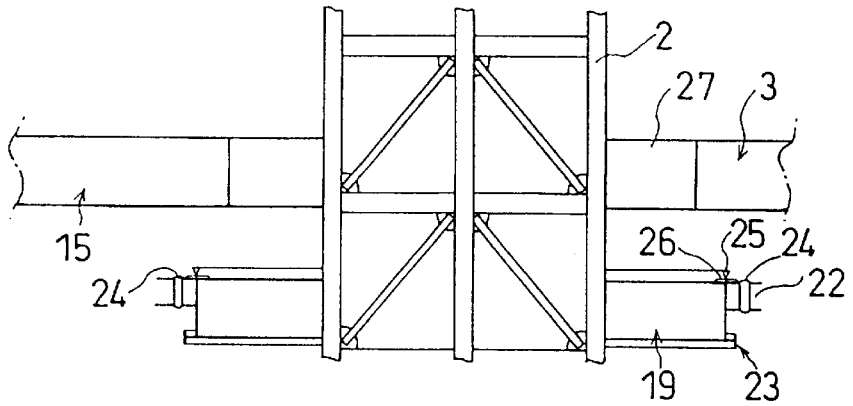
FIG. 4 is a sectional view of the granule transfer apparatus of FIGS. 1A and 1B, showing the engagement between the tower mast, stage, and stage base and taken along the center plane of the tower mast.

FIG. 3 is a plan view (partially perspective) taken from above the top side of the stage 3 and schematically showing the engagement between the tower mast 2, stage 3, and stage base 19. FIG. 4 is a sectional view taken along the center plane of the tower mast 2 and schematically showing the engagement between the tower mast 2, stage 3, and stage base 19.

The stage base 19 is bored with a rectangular hole in its central portion, having a shape and size such that the prism-shaped tower mast 2 can be freely passed through it. The stage base 19 is mounted on the tower mast 2 so as to be vertically movable and nonrotatable. Besides, the stage base 19 is supported on the supporter 21 by means of the hydraulic cylinders 20 that are arranged side by side on the supporter 21 (see FIG. 1B).

The stage base 19 has a generally disk-shaped external shape, and a large-diameter portion 22 and a small-diameter portion 23 are arranged on its outer peripheral portion, as shown in FIG. 4. A channel-shaped peripheral groove is formed on the outer periphery of the large-diameter portion 22, opening outward in the radial direction thereof. An outer peripheral gear is formed on the outside of the large-diameter portion 22 by driving a large number of pins 24 into the peripheral groove so that the pins are arranged at given pitches in the vertical direction on a concentric circle (see FIG. 3).

A rail 25 is fixed to the top surface of the stage base 19 by means of a large number of clips 26 so as to form a circumferential track (see FIG. 3). The rail 25 bears thereon the load of the stage 3 that is rotatably placed on the stage base 19.

Further, a through hole 27 having a diameter a little longer than the diagonal line of a plane section of the tower mast 2 is bored through the central portion of the stage 3 (see FIG. 3). The stage 3 is placed on the stage base 19 for fixed-position rotation with respect to the tower mast 2 and the stage base 19.

More specifically, as shown in FIG. 3, four casters 28 are arranged at regular pitches of 90° on the circumference of a circle on the undersurface of the stage 3, along the circumferential track of the rail 25 on the stage base 19. The stage 3 is placed on the rail 25 by means of the four casters 28.

Figure 6:
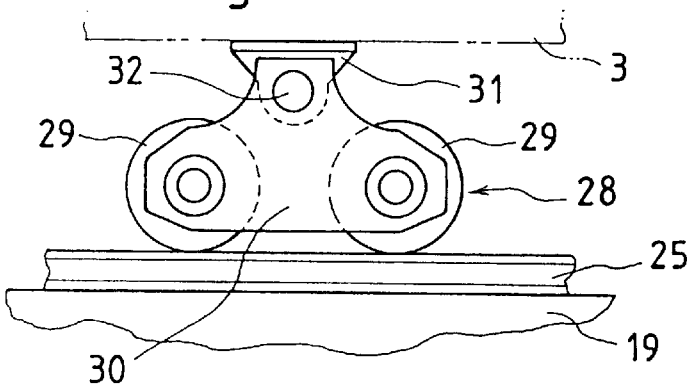
FIG. 6 is view showing a portion taken in the direction of arrow C of FIG. 3.

Referring now to FIG. 6 taken in the direction of arrow C of FIG. 3, there will be described the engagement between the casters 28 fixed to the stage 3 and the rail 25 fixed on the stage base 19.

As shown in FIG. 6, each caster 28 is composed of two rollers 29, a roller receiving member 30 holding the rollers for rotation, and a stay 31 for fixing the roller receiving member 30 to the undersurface of the stage 3. In order to secure the grounding performance of the two rollers 29 on the rail 25, the roller receiving member 30 is mounted on the stay 31 by means of a pin 32 so that it can rock in some measure. In order to avoid unnecessary friction with the rail 25, moreover, the two rollers 29 are rotatably mounted on the roller receiving member 30 in a manner such that the center line of its axis of rotation is in line with a normal to the track of the rail 25, as shown in FIG. 3. The stay 31 is fixed to the undersurface of the stage 3 by welding or other means.

While the stage 3 is placed on the stage base 19 for fixed-position rotation by means of the casters 28 and the rail 25, in this arrangement, the casters 28 should further be prevented from running off the rail 25 inward or outward.

In the present embodiment, as shown in FIG. 3, therefore, four track regulating rollers 33, which externally touch the small-diameter portion 23 of the stage base 19, are rotatably arranged at regular pitches of 90° on the circumference of a circle on the undersurface of the stage 3, whereby horizontal dislocation of the stage 3 on the stage base 19 or derailment of the casters 28 can be prevented.

Figure 7:
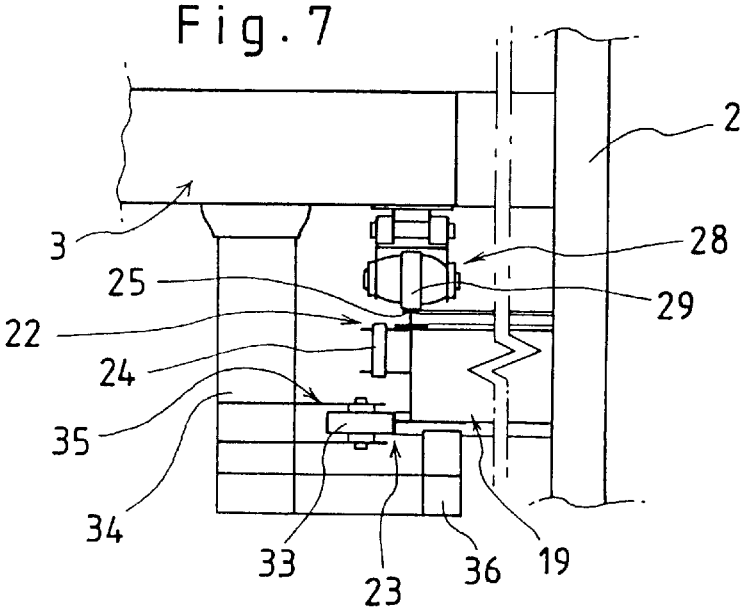
FIG. 7 is view showing a portion taken in the direction of arrow D of FIG. 3.

Referring now to FIG. 7 taken in the direction of arrow D of FIG. 3, there will be described the way the track regulating rollers 33 are mounted on the stage 3 and the engagement between the track regulating rollers 33 and the small-diameter portion 23.

As shown in FIG. 7, a prism-shaped stay 34 extends downward from the undersurface of the stage 3. A second stay 35 extends horizontally from the lower end portion of the stay 34 toward the small-diameter portion 23 of the stage base 19. The aforesaid track regulating roller 33 is rotatably supported on the distal end portion of the second stay 35. The track regulating roller 33 is in sliding contact with the small-diameter portion 23 of the stage base 19. As shown in FIG. 3, the four track regulating roller 33 are arranged so as to hold the small-diameter portion 23 of the stage base 19 between them from outside in the diametrical direction, each two opposite ones forming a pair. Accordingly, the horizontal position of the stage 3 relative to the stage base 19 is regulated completely, so that the casters 28 can never be disengaged from the rail 25 on the stage base 19 even when the stage 3 makes a fixed-position rotation.

The stage 3 and the various means arranged on the stage 3 are designed so that the center of gravity of the whole structure is situated in the center of the stage 3 by means of the counterweight 17. Basically, therefore, the balance and safety of the stage 3 can be secured by only placing the stage 3 for fixed-position rotation on the stage base 19 and preventing positional deviation in the horizontal direction. In order to cope with abnormal vibrations attributable to natural disasters and the like, according to the present embodiment, however, a substantially L-shaped third stay 36 is further fixed to the lower end of the aforesaid stay 34, as shown in FIG. 7. Thus, the stage base 19 is held between the roller 29 of each caster 28 and the top surface of the distal end portion of the third stay 36, whereby the stage 3 is prevented from fluctuating. There is a certain gap between the undersurface of the stage base 19 and the top surface of the distal end portion of the third stay 36, so that the distal end portion of the third stay 36 can never come into contact with the undersurface of the stage base 19 as the stage 3 makes an ordinary fixed-position rotation.

As shown in FIG. 3, means for the fixed-position rotation of the stage 3 on the tower mast 2 and the stage base 19 is composed of a servomotor 37 and a speed reducer 38 fixed on the stage 3, a pinion 40 fixed to the distal end of an output shaft 39 of the speed reducer 38, etc.

Mounted on the output shaft of the servomotor 37 is a detector (not shown), such as a pulse coder, for detecting the rotational speed and rotational position of the servomotor 37, thereby detecting the turn position of the stage 3 that is driven by the servomotor 37. This detector may alternatively be mounted on the output shaft 39 of the speed reducer.

Figure 5:
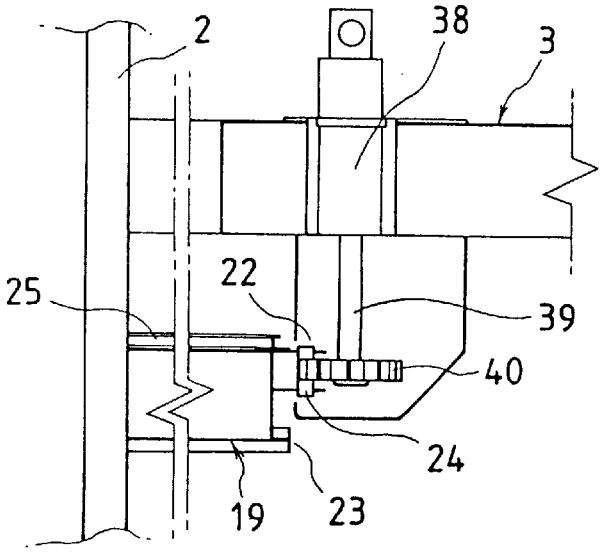
FIG. 5 is view showing a portion taken in the direction of arrow B of FIG. 3.

FIG. 5 shows the principal part of a portion corresponding to arrow B of FIG. 3. As shown in FIG. 5, the output shaft 39 of the speed reducer 38 projects from the back surface of the stage 3. The pinion 40 that is fixed to the distal end portion of the output shaft 39 is in mesh with the pins 24 (i.e., modules of the outer peripheral gear formed on the large-diameter portion 22 of the stage base 19) driven in the large-diameter portion 22 of the stage base 19.

Thus, the stage 3 can be turned around the tower mast 2 and the stage base 19 by driving the servomotor 37 to rotate the pinion 40 through the medium of the speed reducer 38 and the output shaft 39.

Figure 1B:
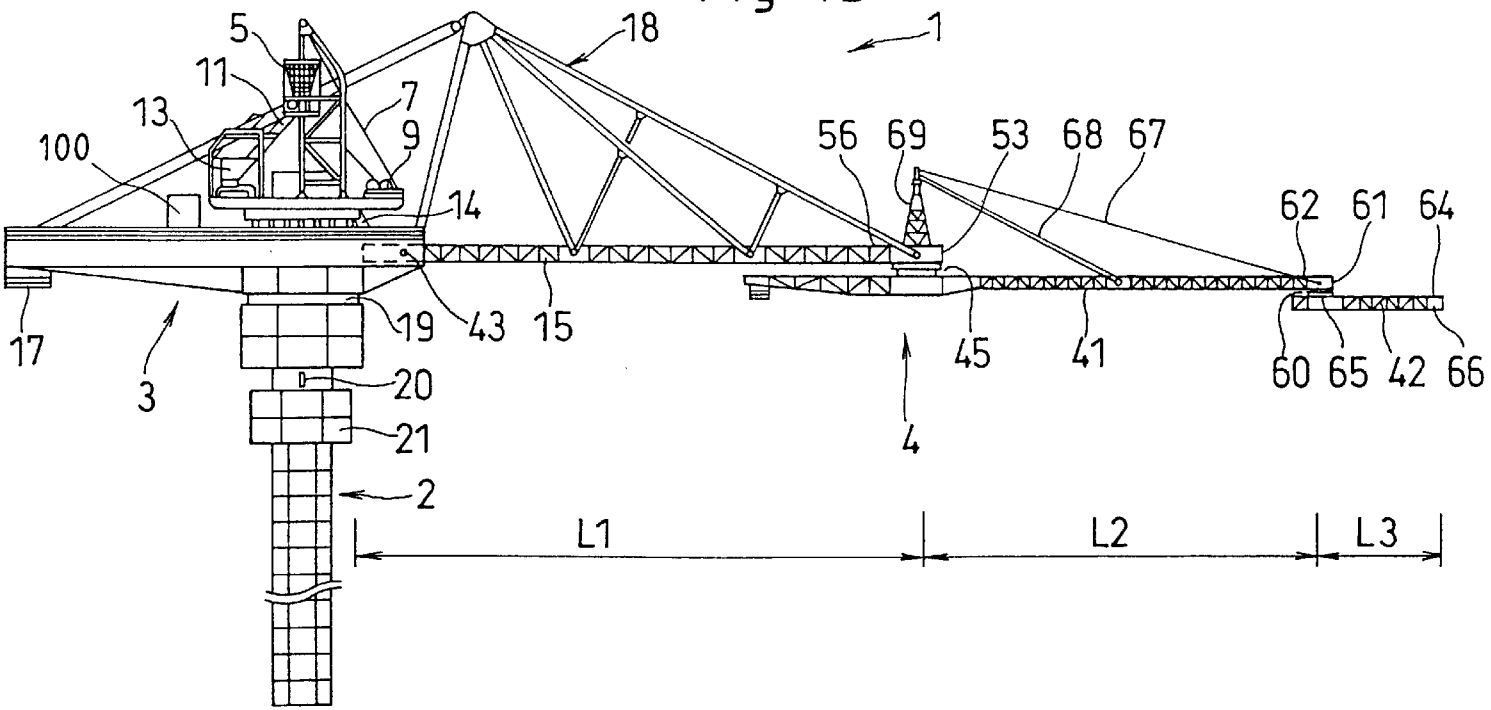
FIG. 1B is a side view of the granule transfer apparatus shown in FIG. 1A.

Referring now to FIGS. 1A, 1B and 3, there will be described the construction of the boom body 4 that is attached to the stage 3.

As shown in FIGS. 1A and 1B, the boom body 4 according to the present embodiment is a three-stage boom that is composed of the first boom component 15, which is situated nearest to the stage 3, a second boom component 41 continuous with the distal end of the first boom component 15, and a third boom component 42 continuous with the distal end of the second boom component 41.

As shown in FIGS. 1B and 3, the first boom component 15, which is situated nearest to the stage 3, is attached to one side of the stage 3 by means of a pin 43, and is supported diagonally from above by means of the aforesaid truss structure 18 that is set up on the stage 3, whereby its rigidity is maintained.

The following is a description of the details of the construction of a pivotal portion between "a stage-side boom component" and "the next boom component" continuous with the former boom component and the construction of the belt conveyor that constitutes the independent granule transfer means for each boom component, taking the case of the relation between the first boom component 15 on the stage side and the next or second boom component 41.

In the relation between the second and third boom components 41 and 42, the second boom component 41 is the stage-side boom component, and the third boom component 42 is the next boom component remoter from the stage (and at the same time, the boom component in the leading position). The pivotal portion between the second and third boom components 41 and 42 and the belt conveyor for each boom component are constructed in the same manner as in the case of the relation between the first and second boom components 15 and 41.

Figure 2B:
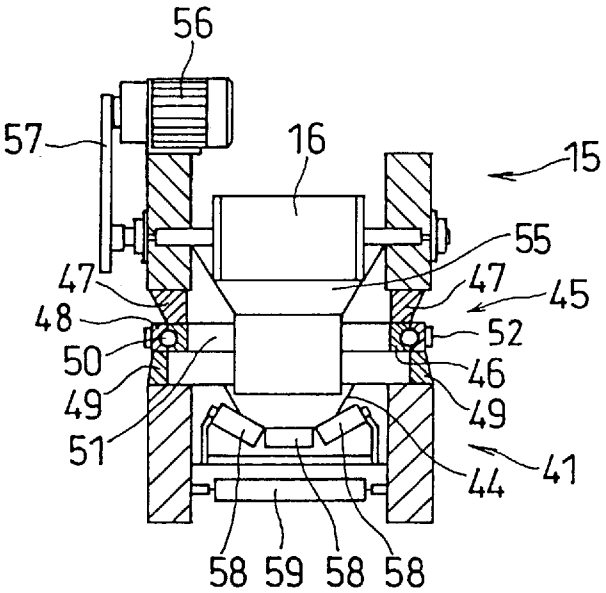
FIG. 2B is a front view of the granule transfer apparatus shown in FIG. 2A.
Figure 2A:
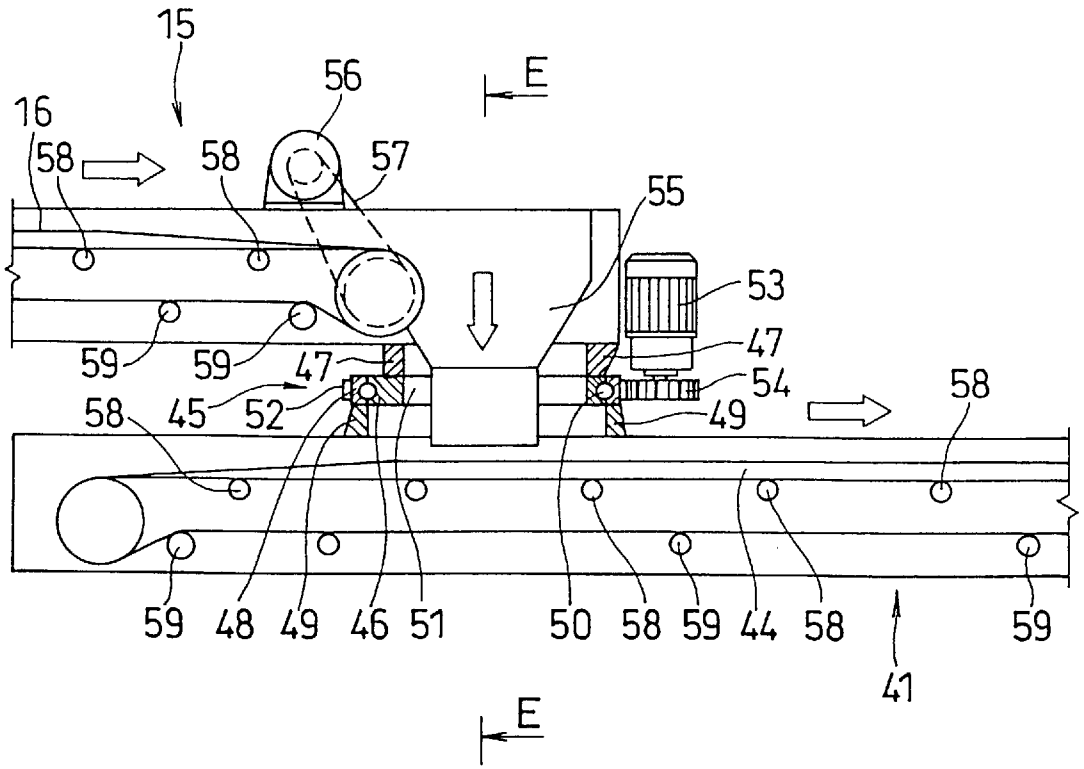
FIG. 2A is a side view (partially in section) showing the way boom components of the granule transfer apparatus of FIGS. 1A and 1B are pivotally mounted and an arrangement of granule transfer means of each boom component.

FIGS. 2A and 2B are perspective views showing the way the first and second boom components 15 and 41 are pivotally mounted and the constructions of belt conveyors 16 and 44 that constitute the granule transfer means for the first and second boom components 15 and 41. FIG. 2A is a side view showing these components, and FIG. 2B is a front view.

As shown in FIG. 2A, an inner ring 46 of an external-tooth turntable bearing 45 is fixed to the undersurface of the distal end portion of the first boom component 15, which is the stage-side boom component, by means of a stay 47, while an outer ring 48 of the external-tooth turntable bearing 45 is fixed to the top surface of the proximal portion of the second boom component 41, which is the next boom component, by means of a stay 49.

As is generally known, the external-tooth turntable bearing 45 is composed of the inner and outer rings 46 and 48 and rollers 50 interposed between the inner and outer rings 46 and 48. The inner and outer rings 46 and 48 are constructed so as to be relatively rotatable and immovable in the thrust direction. The inner ring 46, which is formed of an annular body, is formed with a hole 51. An external gear module 52 is formed on the outer peripheral portion of the outer ring 48 throughout the circumference. Thus, the second boom component 41, which is the next boom component that is continuous with the stage-side boom component (that is, the first boom component 15), is rotatably mounted on the first boom component 15 by means of the external-tooth turntable bearing 45, and the external-tooth turntable bearing 45 constitutes the pivotal portion between the first and second boom components 15 and 41.

Further, a turning mechanism for turning the next or second boom component 41 with respect to the first boom component 15 on the stage side comprises a module 52 formed on the outer peripheral portion of the outer ring 48 of the external-tooth turntable bearing 45, a motor (e.g., servomotor) 53 fixed to the distal end of the first boom component 15 and controllable in position and speed, and a pinion 54 fixed to the distal end of the motor shaft of the motor 53 and in mesh with the module 52.

In short, the second boom component 41, which is fixed to the outer ring 48, is turned with respect to the first boom component 15 by driving the motor 53 to rotate the pinion 54, thereby rotating the outer ring 48 around the inner ring 4 of the external-tooth turntable bearing 45.

Mounted on the motor shaft of the motor 53, moreover, is a detector (not shown), such as a pulse coder, for detecting the rotational speed and rotational position of the motor 53. This detector can detect the turning speed and turning position of the second boom component 41 that is turned with respect to the first boom component 15.

Further, a hopper 55, which is fixed to the distal end portion of the first boom component 15, extends downward through a through hole 51 in the central portion of the inner ring 46 of the external-tooth turntable bearing 45, and constitutes granule delivery means at the junction between the first and second boom components 15 and 41.

The belt conveyor 16 on the side of the first boom component 15 is driven by a motor 56 fixed on the first boom component 15 with the aid of a chain 57, receives the granule discharged from the pressure-feed path 14 (see FIG. 1B) on the side of the stage 3, transports it in the horizontal direction, and discharges it into the hopper 55 that constitutes the granule delivery means at the junction. Further, the granule dropped through the hopper 55 is received by he belt conveyor 44 on the side of the second boom component 41, and is transported in the same manner as in the case of the belt conveyor 16.

As shown in FIG. 2B, rollers 58 that support the top side of the belt conveyors 16 and 44 are divided in three in the width direction of the belt conveyors 16 and 44, and the belt conveyors 16 and 44 are bent to project downward by means of the load of the granule so that the granule can be prevented from dropping out. As shown in FIG. 2B, each of rollers 59 for regulating the respective tracks of the belt conveyors 16 and 44 is in the form of a simple cylinder.

As mentioned before, the pivotal portion between the second and third boom components 41 and 42 and the individual belt conveyors are constructed in the same manner as in the case of the relation between the first and second boom components 15 and 41, so that a detailed description of the arrangement of those components is omitted. In FIG. 1B, numerals are only used roughly to indicate the location of components including an external-tooth turntable bearing 60 that constitutes the pivotal portion between the second and third boom components 41 and 42, a hopper 65 that constitutes granule delivery means at the junction between the second and third boom components 41 and 42, a motor 61 (e.g., servomotor with position and speed detectors), of which the position and speed can be controlled, for rotating the third boom component 42 with respect to the second boom component 41, a motor 62 for driving the belt conveyor 44 of the second boom component 41, a belt conveyor 63 for use as granule transfer means of the third boom component 42, a motor 64 as a drive source for the conveyor 63, and a hopper 66 for dropping the granule from the distal end of the third boom component 42.

The third boom component 42 is a boom component that is situated at the leading end and is preceded by no other boom component which is to rock. Accordingly, the third boom component 42 is not provided with any motor for rocking motion.

Further, a mast 69 is set up on the top surface of the distal end portion of the first boom component 15 on the stage side so as to be coaxial with the central axis of the external-tooth turntable bearing 45 that constitutes the pivotal portion between the first and second boom components 15 and 41. First ends of suspension ropes 67 and 68, such as wires or chains, are fastened to the mast 69. The respective other ends of the suspension ropes 67 and 68 are fastened to the distal end portion and central portion of the second boom component 41. Thus, in the relation between the first and second boom components 15 and 41, the second boom component 41 is diagonally supported from above by means of the suspension ropes 67 and 68 so that its rigidity is maintained. At the same time, an excessive bending moment can be prevented from being generated in the rotating portion of the external-tooth turntable bearing 45.

If the second boom component 41 is short or rigid enough, however, the suspension ropes 67 and 68 are not indispensable.

In the conventional apparatus, as mentioned before, the overall length of the boom body is changed by extending or contracting the next boom component, which is continuous with the stage-side boom component, with respect to this boom component. In the apparatus according to the present invention, however, the overall length of the boom body 4 is changed by turning the next or second boom component 41 with respect to the first boom component 15 on the stage side. Even if the second boom component 41 is turned with respect to the first boom component 15 in order to change the overall length of the boom body 4, therefore, the distance from the distal end of the mast 69 to the distal end portion of the second boom component 41 and the distance from the distal end of the mast 69 to the central portion of the second boom component 41 cannot be changed. It is unnecessary, therefore, to adjust the lengths of the suspension ropes 67 and 68 in turning the second boom component 41 with respect to the first boom component 15.

Accordingly, the suspension ropes 67 and 68 can be easily disposed without using any winch or the like for adjusting the lengths of the suspension ropes 67 and 68, and the rigidity of the next or second boom component 41 and the strength of the external-tooth turntable bearing 45 that constitutes pivotal portion can be ensured.

In the present embodiment, the span of the third boom component 42 at the leading end is short, so that a mast need not be provided on the distal end of the second boom component 41 to support the third boom component 42. In the case where the span of the third boom component 42 is long, however, the mast may be provided on the distal end of second boom component 41 with the same arrangement as aforesaid so that suspension ropes can be fastened to the mast to support the third boom component 42.

In the present embodiment, moreover, the third boom component 42 at the leading end has a short span and small mass, so that it is suited for the case where the third boom component 42 is subjected to weaving for plane spreading such that it is continuously reversibly turned or rocked.

The following is a description of an outline of granule spreading operation by means of the granule transfer apparatus 1 according to the first embodiment.

First, adjustment of a distance r from the origin of a coordinate system based on the tower mast 2, among position adjustments for the hopper 66 for spreading the granule, is achieved by adjusting the angle of turn of the second boom component 41 with respect to the first boom component 15 and the angle of turn of the third boom component 42 with respect to the second boom component 41.

Let it be suppose that the substantial lengths of the first, second, and third boom components 15, 41 and 42 are L1, L2 and L3, respectively, as shown in FIG. 1B. If the second and third boom components 41 and 42 are turned for about ±180° with respect to the first boom component 15 in a manner such that the angle of turn of the third boom component 42 with respect to the second boom component 41 is kept at 0° where L1=60 m, L2=40 m, and L3=12 m are given (i.e., with the second and third boom components 41 and 42 arranged substantially in a straight line to obtain an overall length of L2+L3=52 m), as shown in FIG. 1A, the hopper 66 at the distal end portion of the third boom component 42 (in a granule spreading position) approaches the basal part of the tower mast 2, so that the granule can be spread at the basal part of the tower mast 2.

Thus, the straight distance r from the axis of the tower mast 2 to the hopper 66 can be freely adjusted within a range given by $[L1-(L2+L3)]<r\leqq[L1+L2+L3]$ by regulating the angle of turn of the second boom component 41 with respect to the first boom component 15 and the angle of turn of the third boom component 42 to the second boom component 41.

According to the present embodiment, therefore, the granule can be spread at the basal part of the tower mast 2 ($r\approx L1-(L2+13)$) and spread in either a position ($r\approx L1+L2+13$)) remote from the tower mast 2 or any intermediate position. Accordingly, it is unnecessary to use the tripper device for taking out the granule directly from the belt conveyor of the first boom component that is situated nearest to the stage and spreading it, which is essential to the conventional apparatus in which the overall length of the boom body is adjusted by extending or contracting the next boom component continuous with the stage-side boom component, with respect to this boom component.

In the case where the distance from the tower mast 2 to a target position for spreading is relatively short, that is, if the straight distance r from the axis of the tower mast 2 to the hopper 66 is shorter than the aforesaid [L1+L2+L3], the position of the hopper 66 can be determined in accordance with the combination of (1) a turn angle θ of the stage 3, (2) an angle θ' between the first and second boom components 15 and 41, and (3) an angle θ" between the second and third boom components 41 and 42.

The angles θ, θ' and θ" for the determination of the distance r may be combined in many ways. If the attitudes of the first, second, and third boom components 15, 41 and 42 based on a specific combination of the angles θ, θ' and θ" result in interference with an obstacle, therefore, another combination of the angles θ, θ' and θ" can be selected such that the interference with the obstacle can be avoided. Thus, the granule can be dropped into the target position r.

While the boom body 4 according to the first embodiment is composed of three boom components, the rigidity of the boom components and the pivotal portions can be ensured by means of the simple construction that is formed of the suspension ropes and the mast to which the ropes are anchored. If necessary, therefore, the boom body 4 can be composed of four boom components.

In order to enable the granule to be spread in a desired position through the distal end of the boom body 4 (i.e., from the hopper at the distal end of the leading boom component), however, the boom body may only be provided with at least two pivotal portions for turning the boom components so that it enjoys the degree of freedom of 2.

Thus, according to the first embodiment shown in FIGS. 1A and 1B, the granule can be dropped in the desired target position if the boom body 4 is composed of only the first and second boom components 15 and 41 without the use of the third boom component 42 so that the granule is bound to be discharged through the distal end portion of the second boom component 41. In this case, the distal end of the boom body 4 (hence the distal end of the second boom component 41) can be situated in any desired position within a plane region in which the boom body 4 is movable by controlling the turn angle θ of the stage 3 that supports the boom body 4 and the angle θ' between the first and second boom components 15 and 41.

(Granule transfer apparatus according to second embodiment)

The following is a description of a second embodiment of the present invention, which is composed of a boom body having the degree of freedom of 2 and in which a boom body supporting portion is attached to a vehicle.

Figure 8:
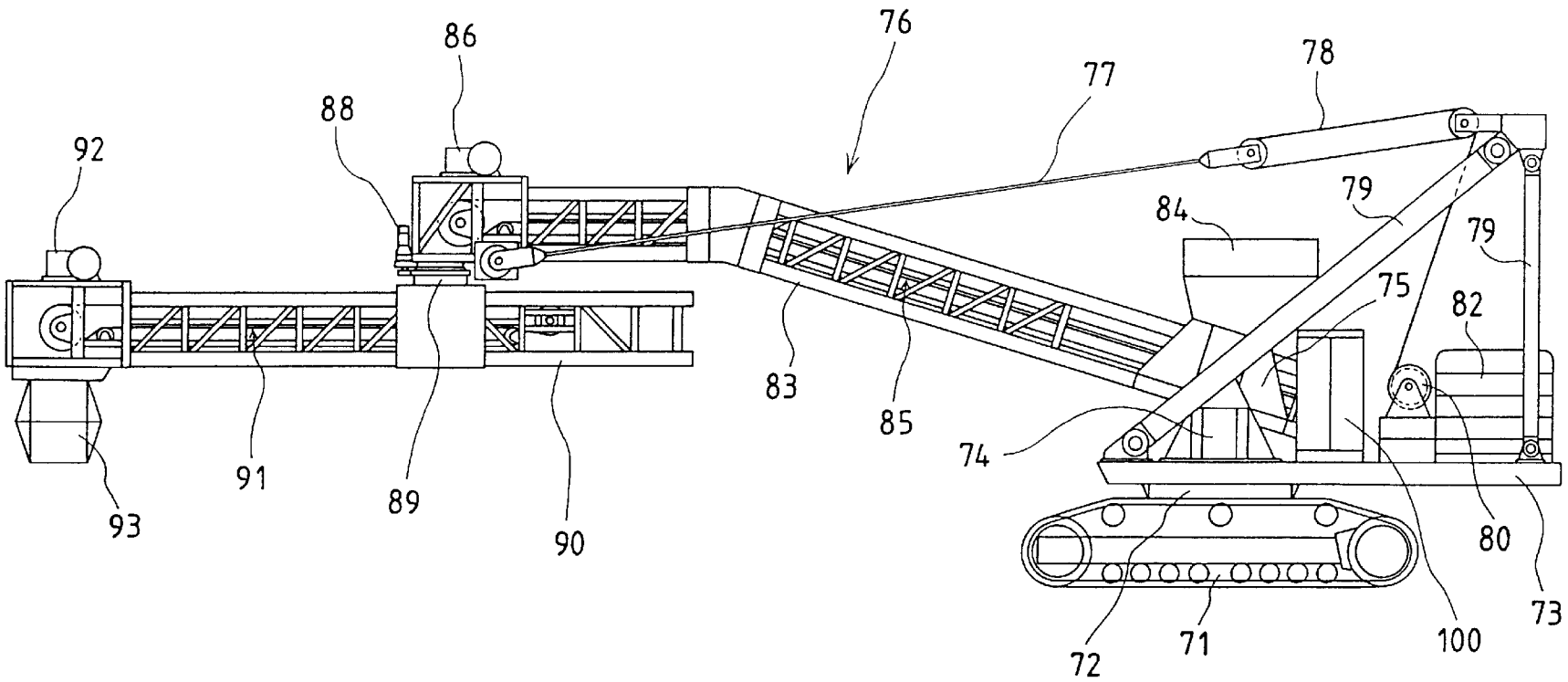
FIG. 8 is a side view of a granule transfer apparatus according to a second embodiment of the present invention.
Figure 9:
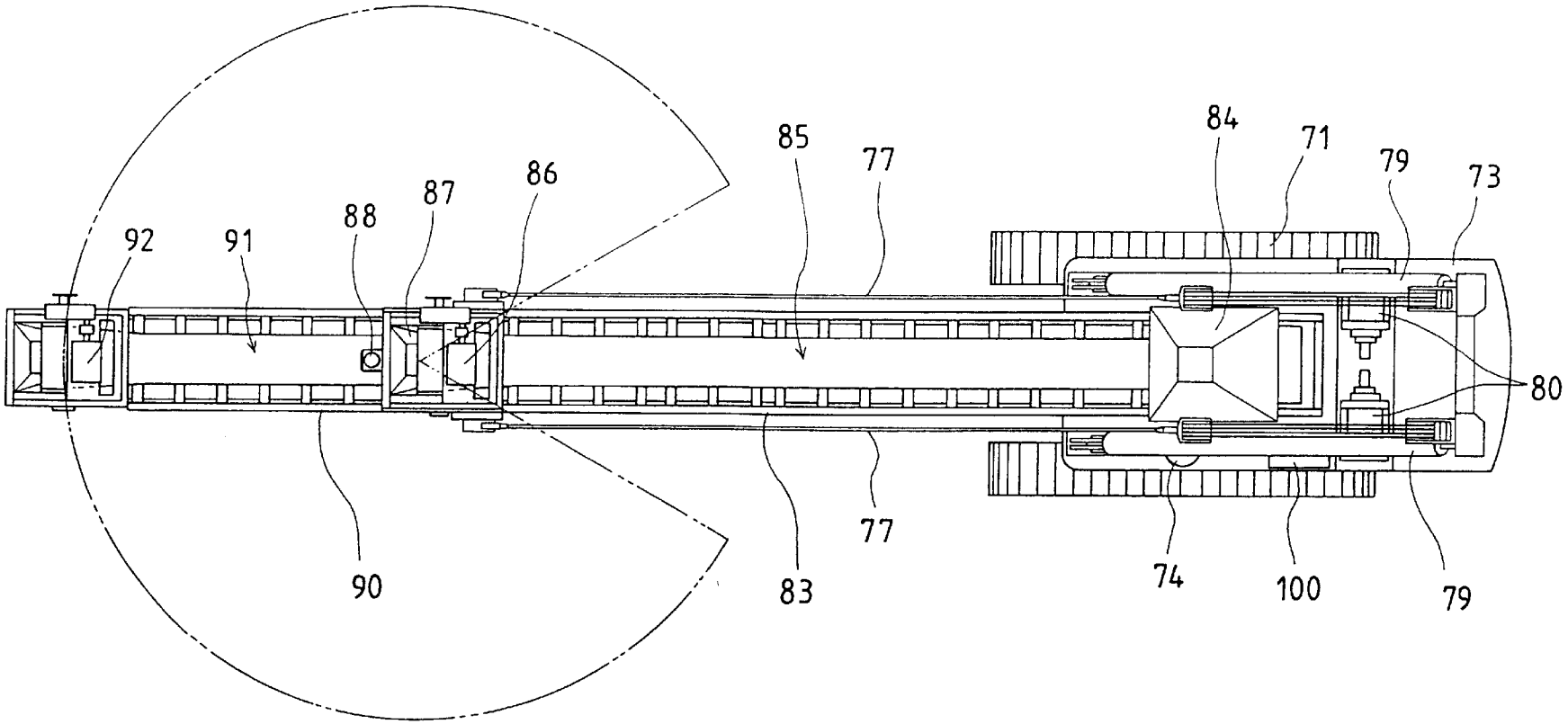
FIG. 9 is a plan view of the granule transfer apparatus of FIG. 8.

FIG. 8 is a side view showing the second embodiment, and FIG. 9 is a plan view. In this second embodiment, a caterpillar tractor 71 having a caterpillar on each side is provided with a boom body supporting portion 72. A stage 73 is rotatably provided on the boom body supporting portion 72 in the same manner as in the first embodiment. The stage 73 is turned with respect to the boom body supporting portion 72 by means of a servomotor 74. Mounted on the rotating shaft of the servomotor 74 is a detector (not shown), such as a pulse coder, for detecting the rotational speed and rotational position of the motor 74. Since a turning mechanism for the stage 73 is constructed in the same manner as the one according to the first embodiment, a detailed description of its construction is omitted.

A pair of boom body mounting members 75 are fixed on the stage 73, and a shaft is stretched between the pair of boom body mounting members 75 so as to extend parallel to the top surface of the stage 73. The basal part of a first boom component 83 of a boom body 76 is rotatably mounted on the shaft.

As shown in FIG. 8, the distal end portion of the first boom component 76 is bent at an angle of about 20° to the other portion. One end of a pendant rope 77 is attached to the distal end portion of the first boom component 83, while a movable pulley is mounted on the other end of the pendant rope 77. An undulating rope 78 is stretched between the movable pulley and a fixed pulley mounted on a frame 79 that is set up on the stage 73. The undulating rope 78 is wound up or off by means of a boom undulating winch 80, whereby the tilt angle of the first boom component 83 can be adjusted.

A counterweight 82 is fixed on that side of the stage 73 which is remoter from the boom body 76, and a controller 100 for controlling the granule transfer apparatus is placed on the stage 73.

As in the first embodiment, the first boom component 83 is provided with a belt conveyor 85 that extends substantially covering the overall length of the first boom component 83. A hopper 84 for delivering the granule to the belt conveyor 85 is located near a pivotal portion between the first boom component 83 and the stage. A motor 86 for driving the belt conveyor 85 is provided on the distal end portion of the first boom component 83, and a hopper as granule delivery means for delivering the granule to a belt conveyor of a second boom component 90 is provided on the leading end portion.

Further, a pivotal portion, similar to the one according to the first embodiment shown in FIG. 2, and a turning mechanism 89 for turning the second boom component are arranged between the first and second boom components 83 and 90. Numeral 88 denotes a servomotor for driving the turning mechanism 89. A detector (not shown), such as a pulse coder, for detecting the rotational speed and rotational position is mounted on the motor shaft of the servomotor 88. Since the turning mechanism 89 and the like are substantially the same as the examples shown in FIG. 2, a detailed description of those elements is omitted.

The second boom component 90 is provided with a belt conveyor 91, which transports the granule delivered from the belt conveyor 85 of the first boom component 83 toward the distal end of the boom component 90. The belt conveyor 91 is driven by a motor 92 that is mounted on the distal end portion of the second boom component 90. Mounted on the distal end of the second boom component 90, moreover, is a hopper 93 that throws out the granule, transported thereto by means of belt conveyor 91, onto the ground.

According to the second embodiment, the boom component 76 is mounted on the caterpillar tractor 71, so that the caterpillar tractor 71 can be moved to be situated in a required position. If the place where the caterpillar tractor 71 is located is inclined, in this case, the boom undulating winch 80 is actuated to adjust the tilt angle of the first boom component 83 so that the distal end of the second boom component 90 can move on the same horizontal plane.

Since the distal end portion of the first boom component 83 is bent, moreover, the angle of turn of the second boom component 90 is about ±150°, as shown in FIG. 9. The angle of turn of the first boom component, i.e., the angle of turn of the stage, can be adjusted to ±180° or more. According to this second embodiment, the angle is adjusted to ±185°.

If the boom body supporting portion 72 is made as tall as a tower mast, as in the case of the first embodiment, the distal end portion of the first boom component 83 need not be bent in the manner shown in FIG. 8. If the boom body supporting portion 72 is made taller, however, its stability worsens. In order to lower the center of gravity, according to the second embodiment, therefore, the boom body supporting portion 72 is limited in height, the first boom component 83 is inclined with its distal end portion bent, and the second boom component 90 is supported on the distal end of the bent portion to secure the height of a granule discharge section at the distal end of the boom body 76, as shown in FIG. 8.

Although the caterpillar tractor 71 having caterpillars is used as a traveling body according to the second embodiment, it may be replaced with a wheeled vehicle. In this case, the vehicle used may be one that is provided with an out-trigger for securing the stability of operation. Further, the traveling body may be a self-propelled vehicle having an engine or the like or a traction vehicle without an engine. If the traveling body is intended for reclamation, then it will be a vessel.

(Controller used in granule transfer apparatus according to first and second embodiments)

Figure 10:
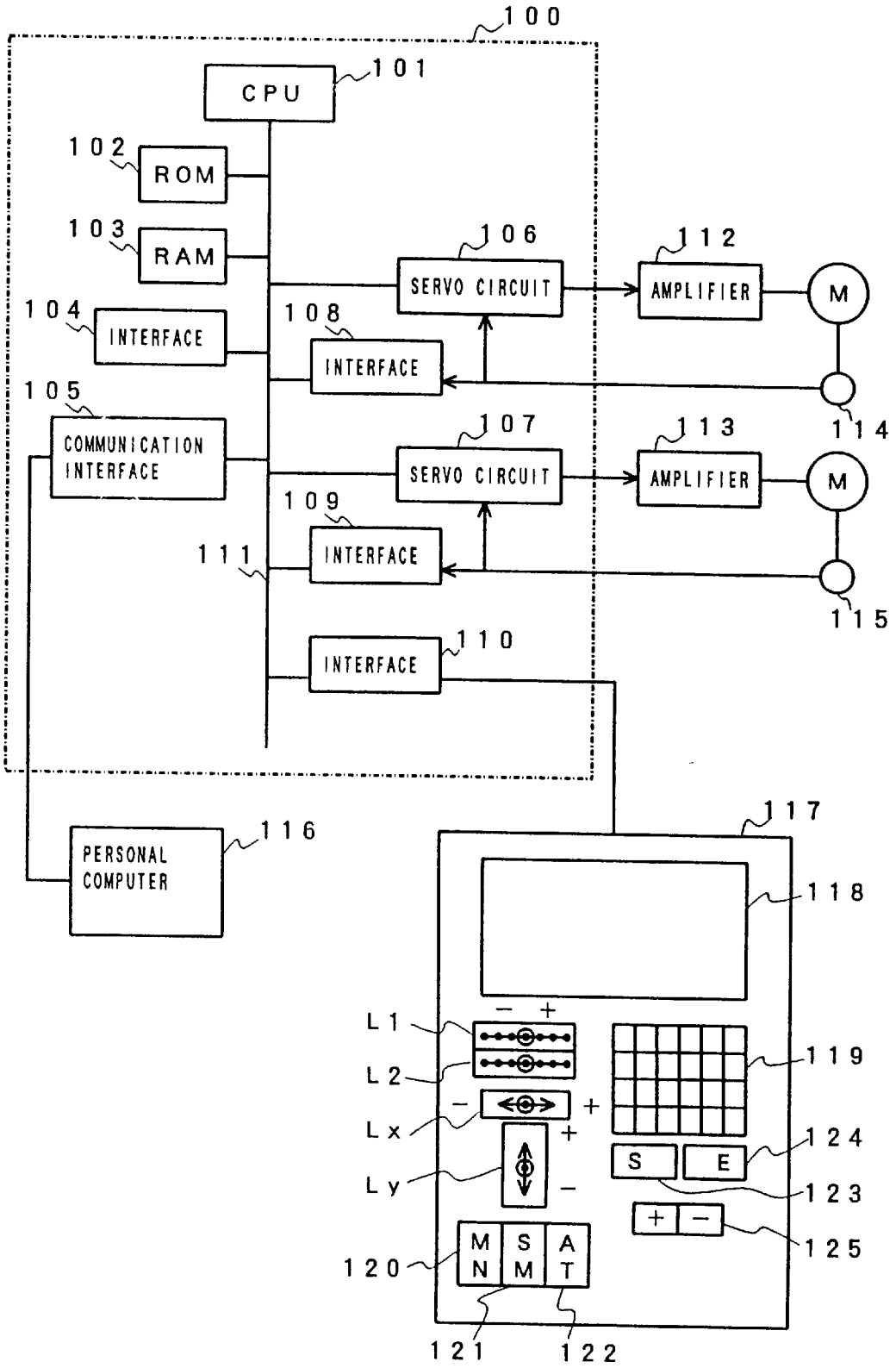
FIG. 10 is a block diagram of a controller used in common in the first and second embodiments of the present invention.

The following is a description of the controller 100 used for the operation of the granule transfer apparatuses according to the first and second embodiments. In the first embodiment, however, there are three boom components that constitute the boom with the degree of freedom of 3, so that three servomotors are used to turn each boom. However, the controller 100 shown in FIG. 10 is applicable to the case where the third boom component 42 is removed so that the boom has the degree of freedom of 2.

In the description to follow, the turning mechanism for turning the stage 3 or 73 (first boom component 15 or 83) is referred to as a first axis, and the servomotor 37 or 74 for driving the first axis as a first servomotor M1, for ease of explanation. Further, the turning mechanism for turning the second boom component 41 or 90 is referred to as a second axis, and the servomotor 53 or 88 for driving the second axis as a second servomotor M2.

The controller 100 includes a processor 101 for generally controlling the granule transfer apparatus. The processor 101 is bus-connected with a ROM 102, RAM 103, interfaces 104, 108, 109 and 110, communication interface 105, and servo circuits 106 and 107.

The ROM 102 is loaded with system programs for the processor 101, and the RAM 103 is utilized for temporary storage of data during the execution of processing. Further, the RAM 103 is provided partially with a nonvolatile memory, and operation pattern programs for automatic operation (mentioned later) are set and stored in the nonvolatile memory. The interface 104 is connected to various actuators and sensors of the granule transfer apparatus, and receives operation commands for the various actuators and signals from the sensors. In the case where the controller 100 is used in the granule transfer apparatus of the first embodiment, the interface 104 is connected to the motors 56 and 62 for driving the belt conveyor, motors for driving the transportation buckets, a drive source for the hydraulic cylinders 20 for finely adjusting the height of the stage 3, etc. In the case where the controller 100 is used in the granule transfer apparatus of the second embodiment, moreover, the interface 104 is connected to the motors 86 and 92 for driving the belt conveyor, boom undulating winch 80, etc.

The communication interface 105 is connected to a personal computer 116 for monitoring various set values and the present position of the distal end of the boom body 3 or 76. In the first embodiment, the controller 100 is situated on the stage 3 over the tower mast 2, and the personal computer 116 is located on the ground. Accordingly, the personal computer 116 and the communication interface 105 are connected by means of a cable, and the personal computer 116 and the communication interface 105 are provided with a serial/parallel converter for converting parallel signals into serial signals and converting serial signals into parallel signals, whereby serial communication is carried out.

The servo circuits 106 and 107 are digital servo circuits that are composed of a digital signal processor (DSP), ROM, RAM, etc., and carry out position loop control, speed loop control, and current loop control. More specifically, the servo circuit 106 drivingly controls the first servomotor M1 (37 or 74) that drives the first axis (or drives the stage 3 or 73). It obtains a position deviation in accordance with a move command delivered from the processor 101 and a position feedback signal from a detector 114 such as a pulse coder, obtains a speed command by multiplying the position deviation by a position loop gain, obtains a speed deviation in accordance with the speed command and a speed feedback signal fed back from the detector 114, and effects proportional-plus-integral control or the like in accordance with the speed deviation, thereby obtaining a torque command. Further, the servo circuit 106 detects the torque command and the driving current of the first servomotor M1 to effect current loop control processing, obtains current commands for individual phases, and drives a servo amplifier 112, which is composed of a transistor-inverter or the like, thereby drivingly controlling the first servomotor M1 (37 or 74).

Moreover, a feedback signal for the position of the first servomotor M1, detected by the detector 114, is applied to the interface 108. Based on a feedback signal for this position, the processor 101 can obtain the rotational position of the servomotor M1, thereby detecting the turn position of the stage 3 or 73 (first boom component 15 or 83).

The servo circuit 107 is a circuit that controls a serve amplifier 113 to drive the second servomotor M2 (53 or 88) for driving the second axis (mechanism for turning the second boom component 41 or 90). The interface 109 is an interface that receives a position feedback from a detector 115 for detecting the rotational position and speed of the second servomotor M2. Since these elements 107, 113, 115 and 109 operate substantially in the same manner as the elements 106, 117, 114 and 108 for drivingly controlling the first servomotor M1, a description of their operations is omitted.

The processor 101 can detect the rotational position of the stage 3 or 73 or the first boom component 15 or 83 and the rotational position of the second boom component 41 or 90 in accordance with position feedback signals for the first and second servomotors M1 and M2 delivered from the detector 114 or 115 to the interface 108 or 109. Therefore, the processor 101 can obtain the distal end position of the boom body 3 or 76 or granule release position, in an XY orthogonal coordinate system set by coordinate transformation, from the rotational positions, and transmit the obtained value to the personal computer 116 and a control panel 117 (mentioned later) and display it.

In the case where the first embodiment is provided with the third boom component 42, which is driven by means of a servomotor, another set of elements including the aforesaid servo circuit, amplifier, inverter, detector must be added.

The interface 110 is connected to the control panel 117 by means of a cable. The interface 110 and the control panel 117 are provided with a converter for converting parallel signals into serial signals and converting serial signals into parallel signals, whereby serial communication is carried out between the interface 110 and the control panel 117. If the controller 100 is situated on the stage 3 over the tower mast 1 so that operation is performed on the ground, as in the case of the first embodiment, the communication path may be replaced with a cable for radio operation. In this case, the interface 110 and the control panel 117 have to be provided with a transmitter and a receiver.

The control panel 117 is provided with a display 118 composed of a CRT or liquid crystal, which displays various set values, present position (position of the boom body end in the set XY orthogonal coordinate system and rotational angle of each boom component), operation mode, set boom body end movement region (set granule spreading region), etc.

In FIG. 10, symbol L1 designates a first boom manual lever for turning the stage 3 or 73 or the first boom component 15 or 83 in accordance with a manual command. L2 designates a second boom manual lever for turning the second boom component 41 or 90. The first and second boom manual levers L1 and L2 are constructed so that they can be moved to the left or right from a center position. If the first boom manual lever L1 is moved to the right, a command is generated to turn the first boom component 15 or 83 in the clockwise direction (+direction) of FIG. 1A or 9 around the boom body supporting portion 2 or 72. If the lever L1 is moved to the left, on the other hand, a command is generated to turn the first boom component in the counterclockwise direction (−direction). Three different speeds can be ordered for either direction, and the individual speeds are separately set in advance. The second boom manual lever L2 is operated in like manner. Thus, commands are generated to turn the second boom component 41 or 90 in the clock and counterclockwise directions at speeds ordered by the lever L2.

Further, operating levers Lx and Ly are semiautomatic operating levers that are used to move the boom body end straight and parallel to the X- or Y-axis in the set XY orthogonal coordinate system. The origin for the angles of turn of the first and second boom components are located on an intermediate point in turnable range, and the first boom component 15 or 83 can rotate for angles of ±185° around the origin. On the other hand, the second boom component 41 or 90 can rotate for about ±150° around the origin.

When the first and second boom components are positioned individually on the origin, the axis of the first boom component 15 or 83 and the axis of the second boom component 41 or 90 are aligned with each other, as shown in FIGS. 1A and 9. This axis position is regarded as a Y-axis position in the XY orthogonal coordinate system, and the X-axis is set in the direction perpendicular to the Y-axis. Thus, in this XY orthogonal coordinate, system, the center of rotation of the first boom component 15 or 83 (stage 3 or 73) is regarded as the origin, the axial direction of the boom body with the rotational positions of the first and second boom components at 0° is received as the Y-axis direction, and the direction perpendicular to the Y-axis is regarded as the X-axis direction. In FIGS. 1A and 9, the direction in which the boom body end is situated is set as the positive Y-axis direction, and the rightward direction perpendicular to the Y-axis direction is set as the positive X-axis direction.

If the X-axis direction semiautomatic lever Lx is moved to the right (or in the +direction) in FIG. 10 with respect to the orthogonal coordinate system set in this manner, a move command is generated to move the boom body end parallel to the X-axis in the positive direction. If the lever Lx is moved to the left (or in the −direction), on the other hand, a move command is generated to move the boom body end parallel to the X-axis in the negative direction. If the Y-axis direction semiautomatic lever Ly is moved upward (or in the +direction) in FIG. 10, a command is generated to move the boom body end parallel to the Y-axis in the positive direction. If the lever Lx is moved downward (or in the −direction), on the other hand, a command is generated to move the boom body end parallel to the Y-axis in the negative direction.

Numerals 120, 121 and 122 denote mode switches. The first and second boom manual levers L1 and L2 are allowed to be operated only when the manual mode switch 120 is turned on. When the semiautomatic mode switch 121 is turned on, the boom body end is allowed to move straight as the semiautomatic levers Lx and Ly are operated. When the automatic mode switch 122 is turned on, moreover, operation based on set programs (pattern operation) can be started.

Numeral 119 denotes numeric keys for setting various commands and data, which include key switches for delivering power-on and -off commands and commands to the boom undulating winch 80, motors 53, 64, 86 and 92 for driving the belt conveyor, and various actuators.

Numerals 123 and 124 denote switches for setting regions for granule spreading, such as fresh concrete placing (mentioned later), and numeral 125 denotes a key switch for ordering the pitch direction of pattern operation for automatic operation, which will be described later.

(Operation of granule transfer apparatus)

Figure 11:
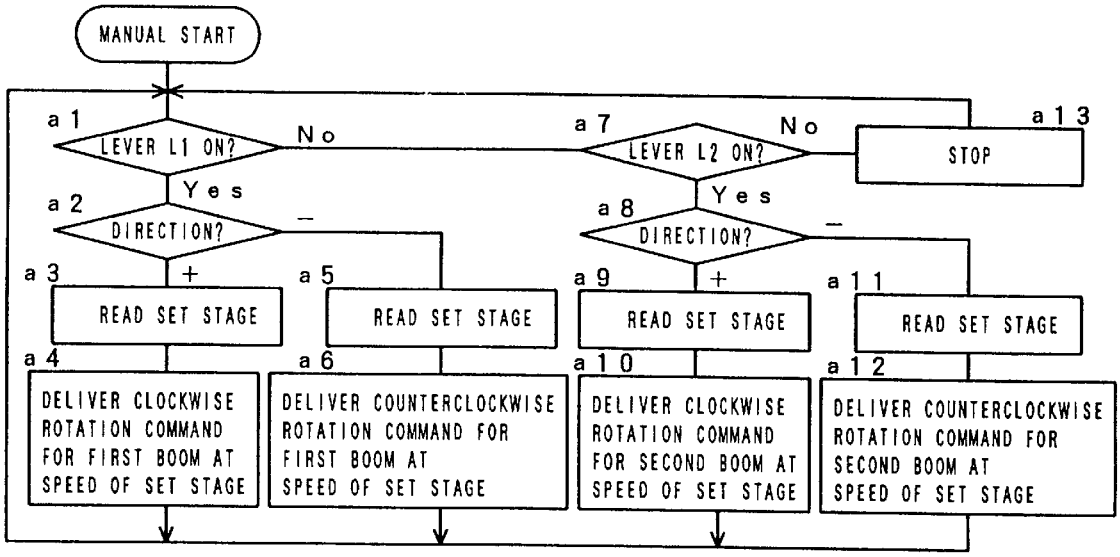
FIG. 11 is a flowchart showing manual processing the controller of FIG. 10 executes.

Referring now to the flowchart of FIG. 11, there will be described the operation of the granule transfer apparatus according to the first or second embodiment having the degree of freedom of 2, carried out in a manual mode by the processor 101 of the controller 100.

When the manual mode switch 120 is turned on, the processor 101 determines whether or not any of the manual levers L1 and L2 have been operated (Steps a1 and a2). If not determined that any of the manual levers have been operated, no movement commands are delivered to the servo circuits 106 and 107, and a stop state is maintained (Step a13).

If the first boom manual lever L1 is operated, then whether the lever is moved in the positive or negative direction is determined, and the stage of the operating position, in terms of the first, second or third, is detected (Steps a2, a3 and a5). If the operating direction of the lever L1 is positive, a move command to rotate the first boom component (stage) in the positive direction (clockwise direction) at a set speed corresponding to the operation stage number is delivered to the servo circuit 106 (Step a4). The processor 101 gives move commands to the servo circuits 106 and 107 with every predetermined distribution period. In this case, movements for the distribution period, corresponding to the ordered direction (positive direction), are delivered to the servo circuit 106.

If the operating direction of the lever L1 is negative, a move command is outputted to rotate the first boom component (stage) in the negative direction (counterclockwise direction) at the set speed corresponding to the operation stage number (Step a6). In consequence, the first boom component (stage) turns in the set speed in the ordered direction at the command speed.

If the second boom manual lever L2 is operated (Step a7), the operating direction and the operation stage are read (Steps a8, a9 and a11), and a move command for movement in the operating direction at the set speed corresponding to the operation stage number is delivered to the servo circuit 107 (Steps a10 and a12). Thereupon, the second boom component turns in the ordered direction at the command speed.

When the manual levers L1 and L2 are returned to their respective neutral positions, the delivery of the move command is stopped (Step a13), and the boom components cease to turn.

The operations by means of the manual levers L1 and L2 include individually turning the boom components in response to manual commands, and are applied to the case where the boom components are individually turned to spread the granule or programs are taught in automatic operation. In the first and second embodiments, in particular, the operations are used in setting the boom body end movement region (granule spreading region).

Figure 12:
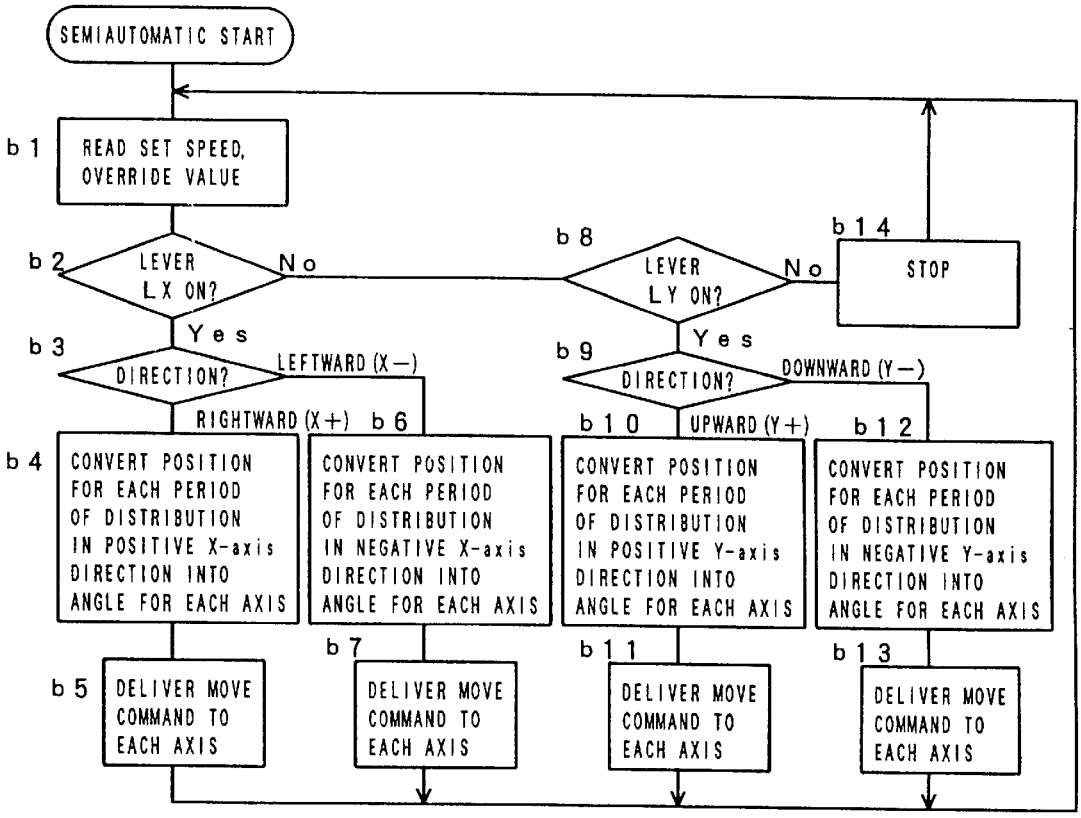
FIG. 12 is a flowchart showing semiautomatic processing the controller of FIG. 10 executes.

Referring now to the flowchart of FIG. 12, there will be described processing the processor 101 executes when the semiautomatic mode switch 121 is turned on to establish a semiautomatic mode.

Before the execution of operation in the semiautomatic mode, the moving speed of the boom body end and an override value are first set in advance by means of the key switches 119. The moving speed is set to be one used in normal automatic operation. The override value determines the actual speed of the boom body end position and is set as a percentage of the set speed. The percentage of the set speed is used as the moving speed. If the override value is set at 60%, for example, the moving speed command for the boom body end position is 60% of the set speed command. By changing this override value, therefore, the speed command to be used actually can be adjusted to any desired value without changing the set speed.

When the semiautomatic mode is selected, the processor 101 reads the set speed and the override value (Step b1), determines whether or not the semiautomatic levers Lx and Ly for the X- and Y-axis directions are operated (Steps b2 and b8). If neither of the levers Lx and Ly are operated, the boom is kept in the stop state without the distribution of the move commands (Step b14).

If it is concluded that the X-direction semiautomatic lever Lx is operated while the processes of Steps b1, b3, b8 and b14 are being repeatedly executed (Step b2), the operating direction of the lever Lx is read (Step b3). If the operating direction is positive, the move command speed is obtained in accordance with the set speed and the override value read in Step b1, and the movement within the distribution period time for the move command corresponding to the move command speed is obtained and settled as the move command for the positive X-axis direction. Further, the respective rotational angles of the individual axes (individual boom components) corresponding to the movement in the aforesaid distribution period are obtained by a transformation matrix for transformation from the orthogonal coordinate system into the respective rotational angles of the individual axes (angles of turn of the first and second boom components), and movements corresponding to the individual rotational angles are delivered to the servo circuits 106 and 107 (Steps b4 and b5).

Thereupon, the servo circuits 106 and 107 carry out feedback control for the position, speed, and current, thereby driving the servomotors M1 and M2 to move the boom body end in the positive direction parallel to the X-axis, as mentioned before.

If it is concluded in Step b3 that the operating direction of the semiautomatic lever Lx is the negative, move commands are delivered to the servo circuits 106 and 107 so that the boom body end moves in the negative direction to the X-axis in the same manner as aforesaid (Steps b6 and b7).

If it is concluded that the Y-direction semiautomatic lever Ly is operated (Step b8), on the other hand, the direction of the move command is read from the operating direction of the lever Ly (Step b9), the movements in the command direction for the distribution period based on the moving speed command obtained according to the set speed and the override value is obtained, the movements are converted into the angles of turn of the individual axes, and the movements corresponding to these angles of turn are delivered to the servo circuits 106 and 107, whereupon the boom body end is moved straight and parallel to the Y-axis in the commanded direction (Steps b10, b11, b12 and b13).

In the semiautomatic mode, as described above, the boom body end can be moved parallel to the X- or Y-axis in the XY orthogonal cooperate system in the positive or negative direction by operating the semiautomatic lever Lx or Ly. Thus, the semiautomatic operation can be utilized in rectilinearly spreading the granule parallel to the X- or Y-axis or in moving the boom body end to an instruction position to set the boom body end movement region (granule spreading region) in an automatic mode, which will be described later.

Referring now to flowcharts of FIGS. 13 to 15, there will be described processing the processor 101 executes in the automatic operation mode.

In the first and second embodiments, the automatic operation is carried out in accordance with set patterns. The set patterns will be described first.

Figure 16:
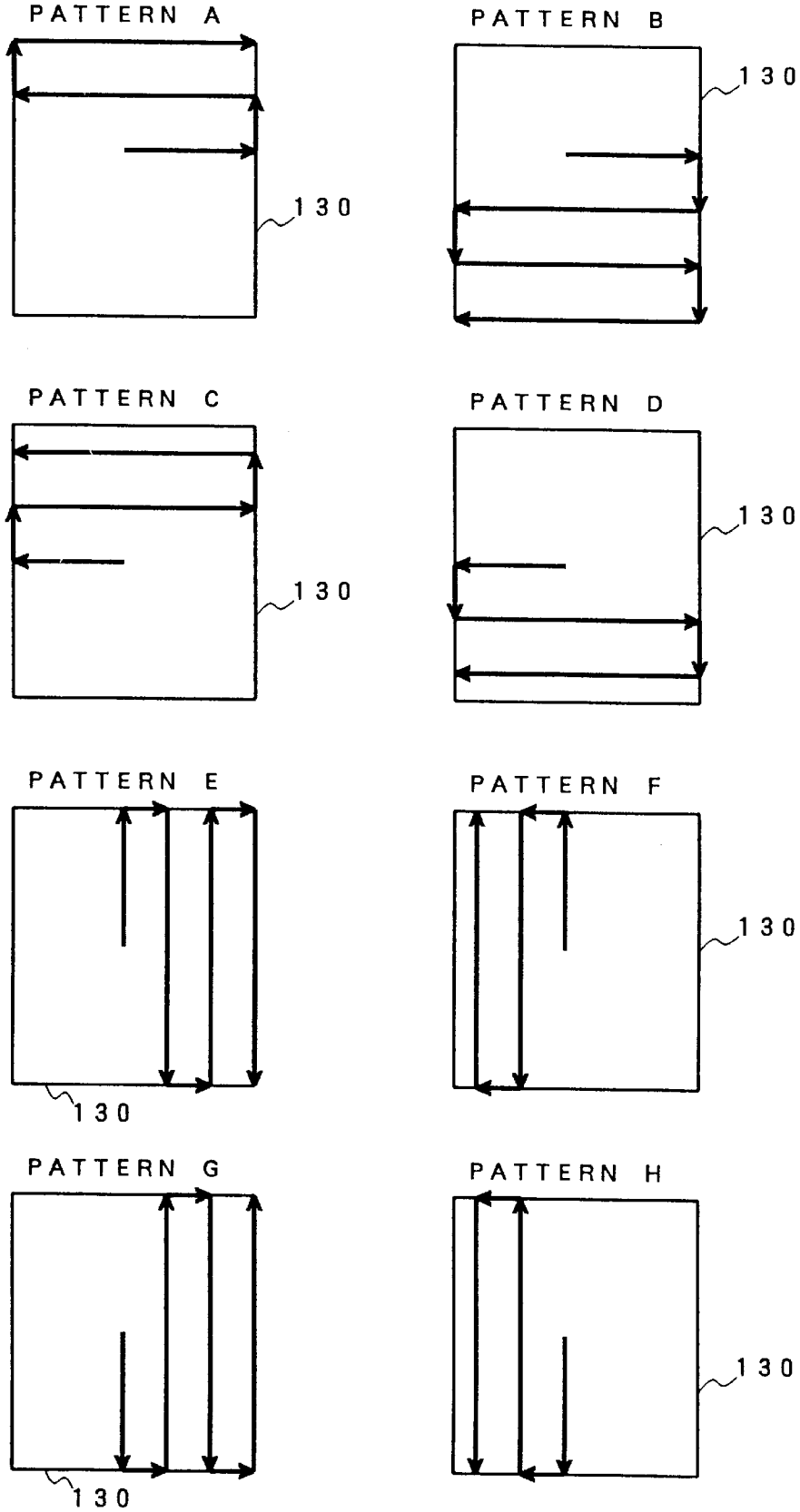
FIG. 16 is a diagram for illustrating the individual patterns handled in the automatic processing of FIG. 13.
Figure 17:
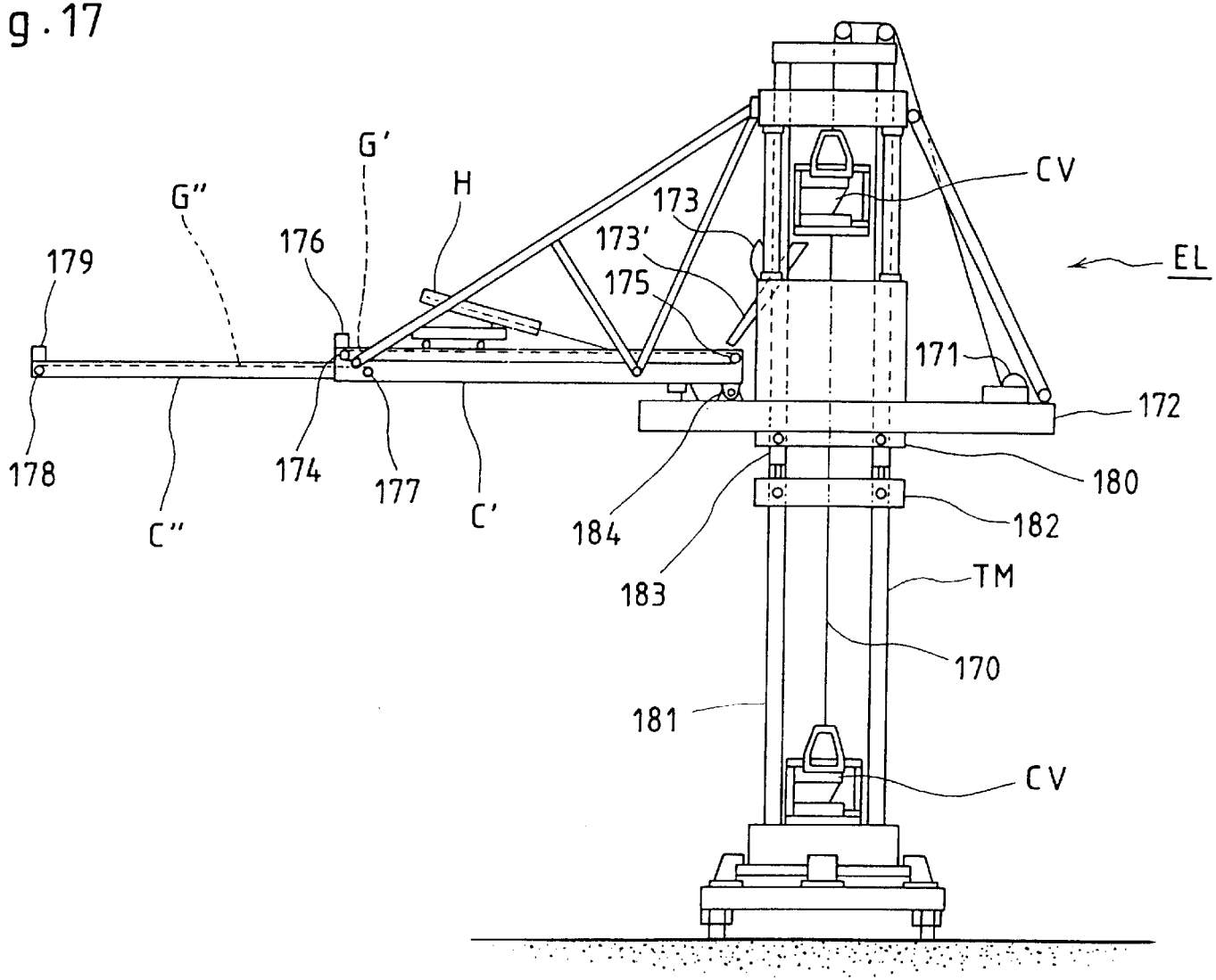
FIG. 17 is a side view of a prior art granule transfer apparatus.

The granule spreading operation, such as fresh concrete placing, consists mainly of spreading on flat surfaces. As shown in FIG. 16, therefore, eight patterns are first supposed to be able to be set for the spreading region (boom body end movement region) and the path of movement of the boom body end in the spreading region. First, eight patterns A to H are set and stored in the following manner, depending on (1) the direction, in terms of the X- or Y-axis direction, in which the boom body end reciprocates, (2) the movement pitch direction, in terms of positive or negative direction, for the reversal of course with respect to the axis perpendicular to the moving direction, and (3) the direction for the first movement at the start of the automatic operation.

| PATTERN | DIRECTION OF RECIPROCATION | DIRECTION AT MOVE START | PITCH DIRECTION |
|---|---|---|---|
| A: | X-axis | X+ | Y+ |
| B: | X-axis | X+ | Y− |
| C: | X-axis | X− | Y+ |

-continued

| PATTERN | DIRECTION OF RECIPROCATION | DIRECTION AT MOVE START | PITCH DIRECTION |
|---|---|---|---|
| D: | X-axis | X− | Y− |
| E: | Y-axis | Y+ | X+ |
| F: | Y-axis | Y+ | X− |
| G: | Y-axis | Y− | X+ |
| H | Y-axis | Y− | X− |

Figure 13:
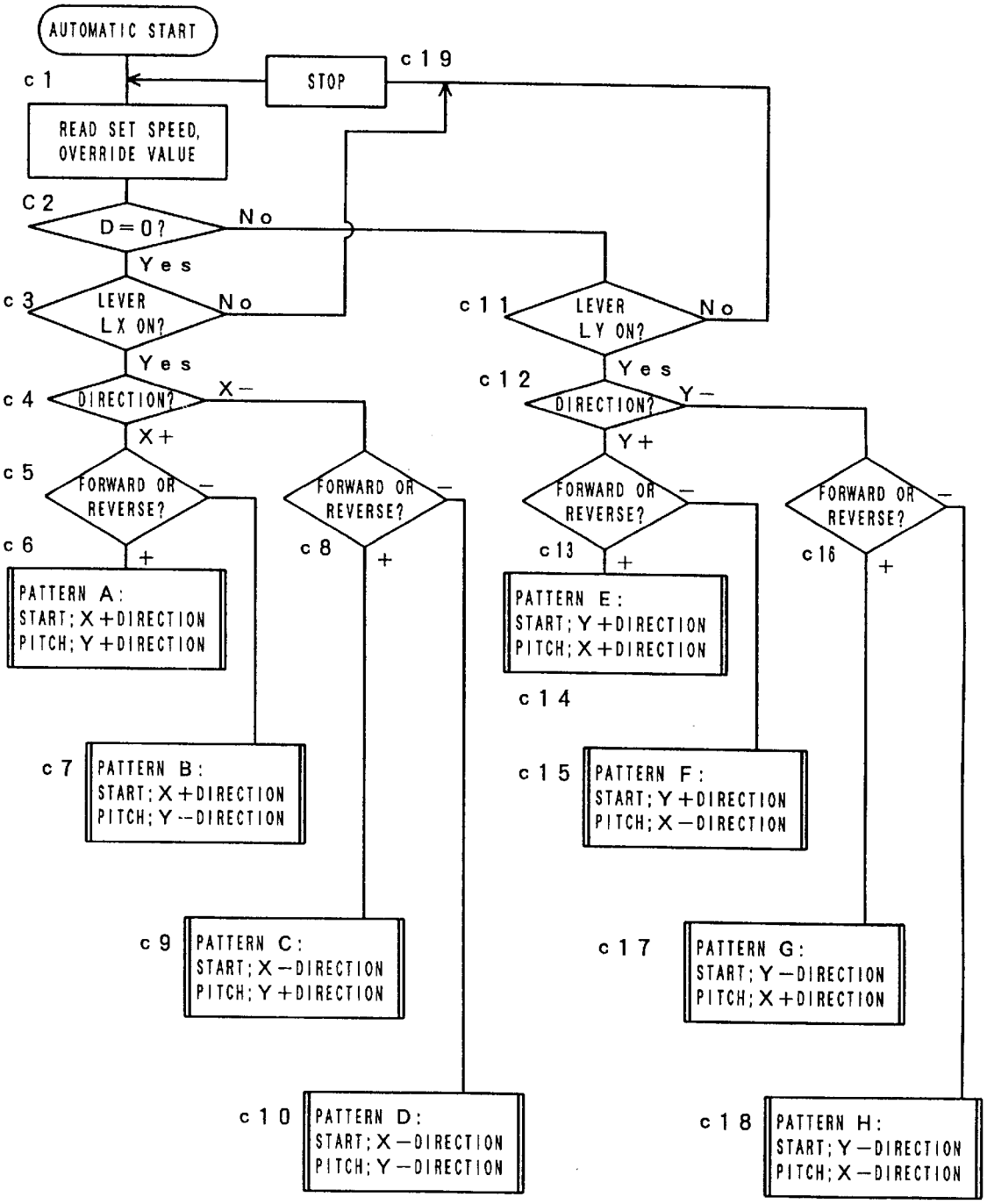
FIG. 13 is a flowchart showing automatic processing the controller of FIG. 10 executes.

In the embodiment shown in FIG. 13, the direction of reciprocation is settled by previously setting a flag D. In the case where the flag D is set at "0", the moving direction is adjusted to the X-axis direction. If the flag is set at "1", the moving direction is adjusted to the Y-axis direction. The moving direction at the start of the automatic operation is ordered according to the operating direction of the X- or Y-axis semiautomatic lever Lx or Ly. The pitch direction is selected by means of the reversible switch 125.

Further, the moving direction for rectilinear movement is set in accordance with the set speed and the override value (moving speed =set speed×override value). Furthermore, a pitch value and a spreading region 130 (see FIG. 16) are set. The setup of the spreading region (boom body end movement region) 130 is effected by moving the boom body end by the aforementioned manual, or semiautomatic operation and giving instructions for two points on a diagonal line of the target spreading region. Thus, XY coordinate positions (respective rotational angles of the first and second boom components) are taught and stored by depressing the spreading start position instruction switch 123 after positioning the boom body end in a spreading start position.

Then, the XY coordinate positions (respective rotational angles of the first and second boom components) are taught and stored by positioning the boom body end in a position diagonal to the spreading start position in the rectangular target spreading region and depressing the spreading end key switch 124. If the XY coordinate position for the taught spreading start position and a spreading end position are (Xs, Ys) and (Xe, Ye), respectively, the spreading region 130 is set as a rectangular region having an X-axis value between Xs and Xe and a Y-axis value between Ys and Ye.

The processor 101 of the controller 100 starts the processing of FIG. 13 if the automatic mode switch 122 is turned on after the spreading region 130, set speed override value, pitch value, direction of reciprocation (flag D indicative of the X- or Y-direction), and reversible switch 125 for settling the pitch direction are set in the manner described above and the boom body end position is situated in the spreading region 130 manually or semiautomatically (normally, situated at the spreading start position).

First, the set speed and the override value are read (Step c1), and whether or not the flag D for storing the set direction of reciprocation is "0" is determined (Step c2). If the flag D is "0", whether or not the X-direction semiautomatic lever Lx (this lever Lx serves as a lever for adjusting the moving direction at the start of the automatic operation to the X-axis direction) is operated is then determined (Step c3). If the flag D is "1", on the other hand, whether or not the Y-direction semiautomatic lever Ly (this lever Ly serves as a lever for adjusting the moving direction at the start of the automatic operation to the Y-axis direction) is operated is determined (Step c11). If neither of the levers Lx and Ly is operated, the delivery of the move command is stopped so that the movement of the boom components is stopped (Step c19).

The motors for driving the belt conveyor and bucket are then actuated, it is ascertained that dropping of the granule from the boom body end is started, and the direction of reciprocation is adjusted to the X-axis direction (flag D=0). If an operator moves the X-direction semiautomatic lever Lx in, for example, the positive direction in this case (Step c4), the processor 101 concludes that "the moving direction for the start of the automatic operation is the positive X-direction" (If the semiautomatic lever for the direction different from the set direction of reciprocation is operated, it is ignored. If the Y-direction semiautomatic lever Ly is operated with the flag D=0, for example, it is ignored.) Further, reversal setting by means of the reversible switch 125 (switch for settling the pitch direction, positive or negative) is determined (Step c5). If the lever Lx is operated in the positive (+) direction, and if the reversible switch is set in the positive (+) direction, then the processor 101 starts processing the pattern A.

Figure 14A:
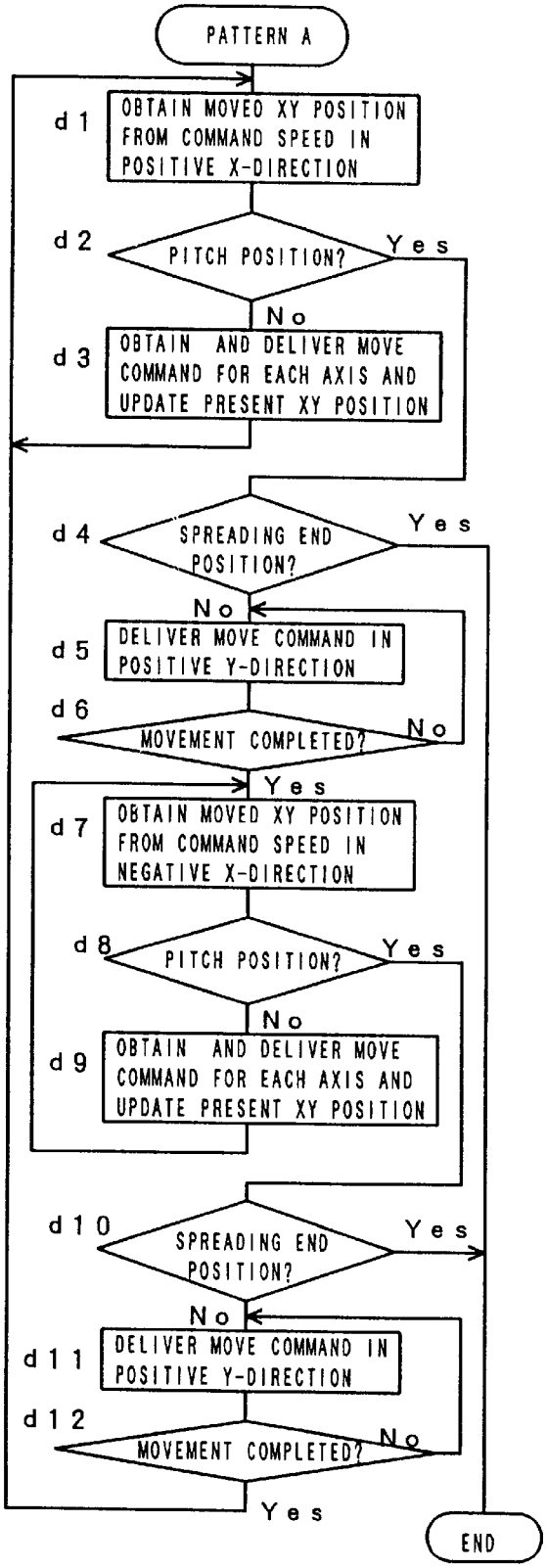
FIG. 14A is a flowchart showing processing of a pattern A executed in the automatic processing of FIG. 13.

Referring now to the flowchart of FIG. 14A, there will be described the processing of the pattern A executed by the processor 101.

First, the movements for the distribution period corresponding to the moving speed that is settled depending on the set speed and the override value are obtained, these movements are added to the present X coordinate position of the boom body end, and the XY coordinate position of the boom body end moving in the present distribution period, on the orthogonal cooperate system, is obtained (Step d1). Then, whether or not this position is a pitch position is determined. At this point of time, the decision implies a move command in the positive X-axis direction, so that the pitch position takes a maximum value on the X-axis of the spreading region 130. Accordingly, it is determined by whether or not this maximum X-axis value is reached by a position ordered in the present distribution period (Step d2).

If this pitch position is not reached, the respective rotational angles of the individual axes corresponding to the XY coordinate position for the boom body end moving in the present distribution period are obtained by the transformation matrix for transformation from the XY coordinate system into the rotational angles, movements corresponding to the rotational angles are delivered to the rotation servo circuits 105 and 107, and the XY coordinate value is updated (Step d3), whereupon the program returns to Step d1. As mentioned before, the servo circuits 105 and 107 carry out feedback control operations for the position, speed, and current, thereby driving the servomotors M1 and M2 to move the boom body end in the positive direction parallel to the X-axis.

Thereafter, the processes of Steps d1 to d3 are executed repeatedly, whereby the boom body end is moved in the positive X-axis direction at a moving speed based on the set speed and the override value. If it is concluded that a maximum X-coordinate value of the spreading region 130 is reached or exceeded by the X-axis coordinate value of the boom body end position to be moved with every distribution period (Step d2), whether or not the spreading end position is reached is determined (Step d4). Since the pitch direction for the pattern A is the positive Y-axis direction, this decision depends on whether or not a maximum Y-coordinate value of the spreading region 130 is exceeded by a value obtained by adding the pitch value to the Y-axis coordinate value of the present position. If the maximum value is exceeded, it implies that spreading into the spreading region 130 is finished, so that the automatic operation terminates. If the maximum value is not exceeded, on the other hand, pitch operation is carried out. Thus, movements for the distribution period during which the boom body end moves in the positive Y-axis direction at the moving speed are obtained and added to the Y-axis coordinate value of the present position, so that a target position is obtained, then the respective rotational angles of the individual axes are obtained from this position, and movements of the servomotors M1 and M2 for the rotational angles are obtained and outputted (Step d5). A move command for moving by a set pitch value is outputted, and whether or not the boom body end is moved by the pitch value is determined (Step d6). If this is not done, the processes of Steps d5 and d6 are executed repeatedly.

When the boom body end is thus moved for the set pitch value, the coordinate position in the orthogonal cooperate system of the boom body end moving in the distribution period for the movement in the negative direction at the aforesaid moving speed is obtained (Step d7), and whether or not this position is the pitch position is determined (Step d8). Since this decision implies a movement in the negative X-axis direction, it depends on the determination as to whether or not a minimum X-axis coordinate position of the spreading region 130 is exceeded by the X-axis coordinate position of the position to be moved. The pitch position is not reached yet if the minimum X-axis coordinate position of the spreading region 130 is exceeded by the X-axis coordinate position of the position to be moved. Therefore, the respective rotational angles of the individual axes corresponding to the XY coordinate position for the boom body end moving in the present distribution period are obtained by the transformation matrix for transformation from the XY coordinate system into the rotational angles, movements corresponding to the rotational angles are delivered to the rotation servo circuits 105 and 107, and the XY coordinate value is updated (Step d9), whereupon the program returns to Step d7. Thereafter, the processes of Steps d7 to d9 are executed repeatedly.

If it is concluded in Step d8 that the minimum X-axis coordinate position of the spreading region 130 is not exceeded by the X-axis coordinate position to be moved and that a pitch switching position is reached, the program proceeds to Step d10, whereupon whether or not the spreading end position is reached is determined. This decision is the same process as the one in Step d4. The set pitch value is added to the present Y-axis coordinate value, and whether or not the maximum Y-axis coordinate value of the spreading region 130 is exceeded by the resulting value is determined. If the maximum value is exceeded, the automatic spreading operation is finished. If the maximum value is not exceeded, on the other hand, a move command for moving by the set pitch value in the positive Y-axis direction as in Steps d5 and d6 is outputted (Steps d11 and d12). When this pitch operation is completed, the program returns to Step d1, whereupon the aforementioned process of Step d1 and the subsequent processes are executed.

Returning to FIG. 13, processing of the pattern B is started if it is concluded in the process of Step c5 that the reversible switch 125 is set at "reverse (−)". More specifically, the processing of the pattern B is started when the flag D is set at "0" so that the direction of reciprocation is the X-axis direction and if the positive X-axis direction and the negative Y-axis direction are ordered as the first moving direction and the pitch direction, respectively.

Figure 14B:
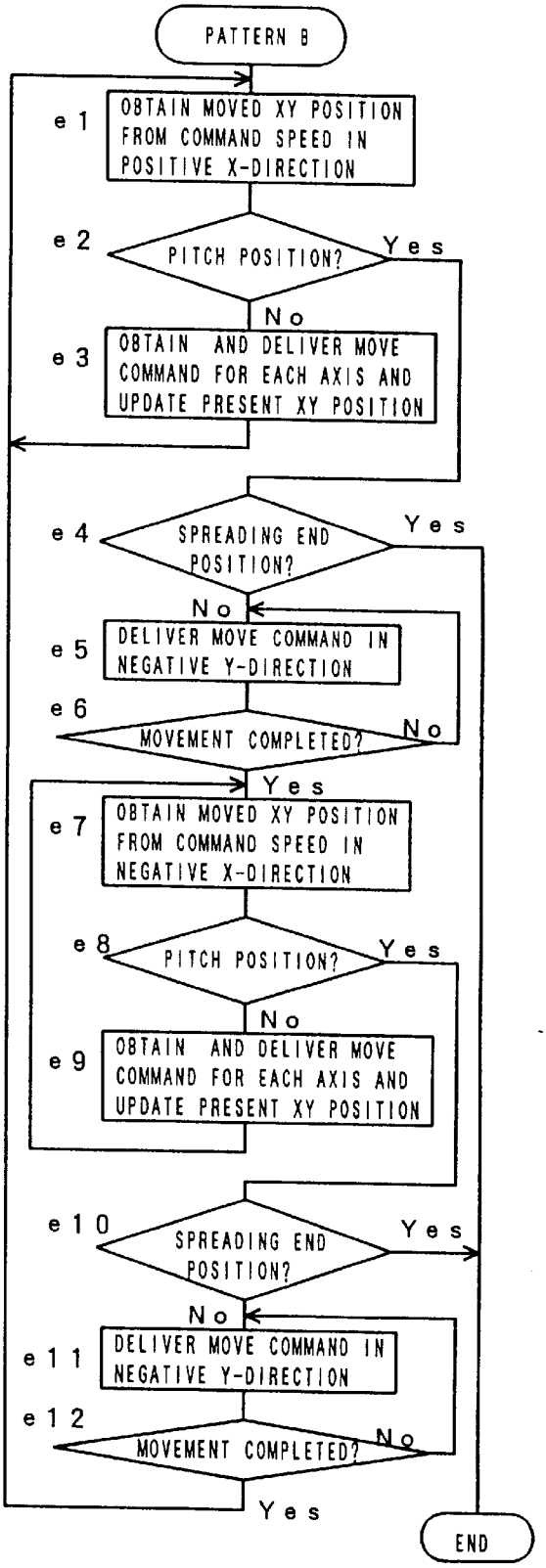
FIG. 14B is a flowchart showing processing of a pattern B executed in the automatic processing of FIG. 13.

FIG. 14B is a flowchart for the processing of the pattern B executed by the processor 101 of the controller 100. The pattern B differs from the aforesaid pattern A only in that the pitch direction is reverse (negative Y-axis direction). Thus, the flowcharts are different in the following points. While the pitch direction for Steps d5 and d11 for the pattern A is the positive Y-axis direction, that for Steps e5 and e11 is the negative Y-axis direction. In Steps e4 and e10, moreover, the spreading end position is detected depending on whether or not a value obtained by subtracting the set pitch value from the present Y-axis coordinate position is not greater than a minimum Y-axis value of the spreading region 130 is determined, and the automatic spreading operation is finished if the obtained value is not greater. Since the other processes are executed in the same manner, a detailed description of those processes is omitted.

Further, the processor 101 starts processing the pattern C if flag D=0 is given so that the X-direction semiautomatic lever Lx is operated in the negative direction with the reversible switch 125 set at "forward (+)" (Steps c2, c3, c4 and c8), as shown in FIG. 13.

The processing of the pattern C (not shown) differs from the processing of the pattern A in that the direction for the start of the first movement for the pattern C is the negative X-axis direction, while that for the pattern A is the positive X-axis direction. Thus, the processing of the pattern C differs from the processing of the pattern A only in the following points. In FIG. 14A, the "positive X-axis direction" is replaced with the "negative X-axis direction" in the process of Step d1, and the "negative X-axis direction" is replaced with the "positive X-axis direction" in the process of Step d7. While the detection of the pitch position in Step d2 depends on whether or not the minimum X-axis coordinate position of the spreading region 130 is not exceeded by the X-axis coordinate position to be moved, the detection of the pitch position in Step d8 depends on whether or not the value of the X-axis coordinate position to be moved is not smaller than the maximum value of the X-axis coordinate position of the spreading region 130.

If it is concluded in Step c8 of FIG. 13 that the reversible switch 125 is set at "reverse (−)", the processor 101 carries out processing of the pattern D. The processing of the pattern D (not shown) differs from the processing of the pattern B shown in FIG. 14B in that the direction for the start of the first movement for the pattern D is the negative X-axis direction, while that for the pattern B is the positive X-axis direction. Thus, the processing of the pattern D differs from the processing of the pattern B only in the following points. In FIG. 14B, the "positive X-axis direction" is replaced with the "negative X-axis direction" in the process of Step e1, and the "negative X-axis direction" is replaced with the "positive X-axis direction" in the process of Step e7. While the detection of the pitch position in Step e2 depends on whether or not the minimum X-axis coordinate position of the spreading region 130 is not exceeded by the X-axis coordinate position to be moved, the detection of the pitch position in Step e8 depends on whether or not the value of the X-axis coordinate position to be moved is not smaller than the maximum value of the X-axis coordinate position of the spreading region 130.

Figure 15A:
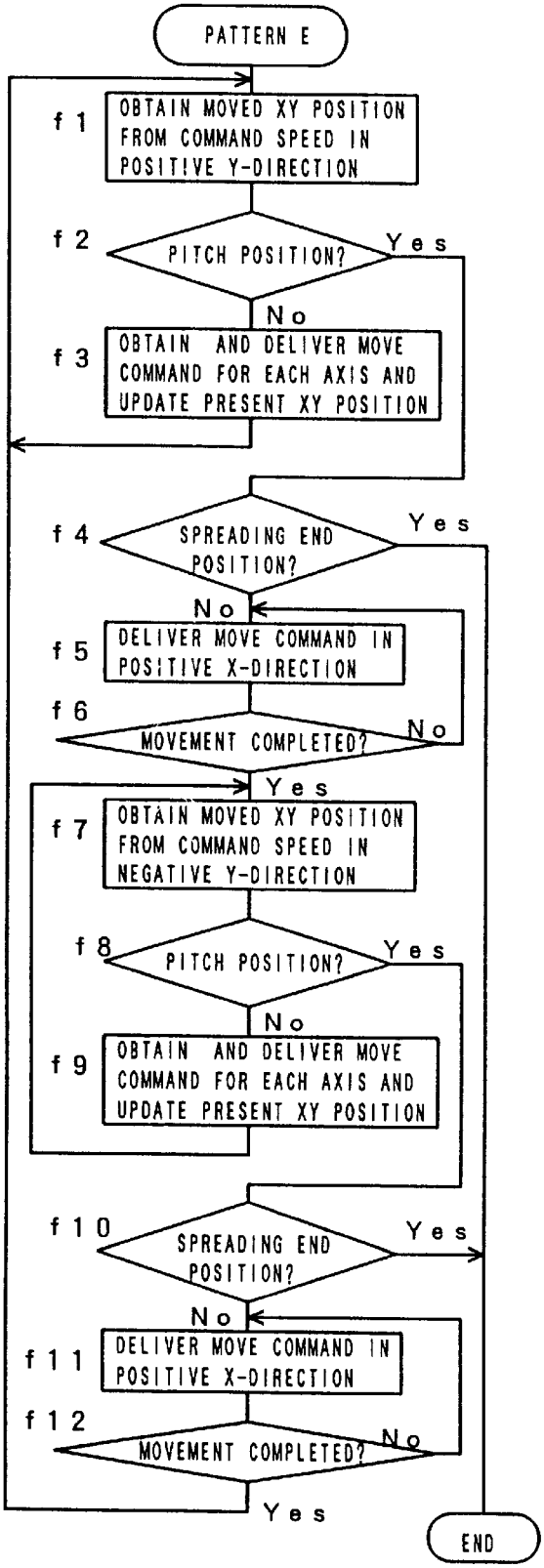
FIG. 15A is a flowchart showing processing of a pattern E executed in the automatic processing of FIG. 13.

Returning to FIG. 13, processing of the pattern E is started (Step c14) when the flag D is set at "1" (Step c2), the Y-axis semiautomatic lever Ly is operated (Step c11), its operating direction is positive direction (Step c12), and the reversible switch 125 is set at "forward (+)" (Step c13). FIG. 15A is a flowchart showing the processing of the pattern E. The pattern E and the pattern A are different in the reciprocal relation between the X- and Y-axes. For the pattern E, the direction of reciprocation is the Y-axis direction, and the pitch direction is the positive X-axis direction. Thus, the detection of the pitch position in Step f2 depends on whether or not the value of the Y-axis coordinate position to be moved is not smaller than the maximum Y-axis value of the spreading region 130, while the detection in Step f8 depends on whether or not the value of the Y-axis coordinate position to be moved is not greater than the minimum Y-axis value of the spreading region 130. Further, it is concluded in Steps f4 and f10 that the automatic spreading is finished if the maximum X-axis value of the spreading region 130 is exceeded by a value obtained by adding the pitch value to the present X-axis coordinate position. Since the processing of the pattern E differs from the processing of the pattern A only in the points described above, it is only illustrated in the flowchart of FIG. 15A, and a detailed description of the processing is omitted.

If it is concluded that the reversible switch 125 is set at "reverse (−)" in Step c13 of FIG. 13, the processor 101 starts processing the pattern F (Step c15). The processing of the pattern F is the processing shown in FIG. 15B. As seen from the comparison between FIGS. 15A and 15B, the processing of the pattern F differs from the processing of the pattern E only in the following points. In the processes of Steps g5 and g11, the pitch direction is the negative X-axis direction. Besides, the detection of the termination of automatic spreading in Steps g4 and g10 depends on whether or not a value obtained by subtracting the set pitch value from the present X-axis coordinate value is not greater than the minimum X-axis value of the spreading region 130.

The processor 101 carries out processing of the pattern G (Step c17) when the flag D is set at "1", the Y-axis semiautomatic lever Ly is operated in the negative direction, and the reversible switch 125 is set at "forward (+)" (Steps c3, c11, c12 and c16). If the reversible switch 125 is set at "reverse (−)", on the other hand, the processor 101 carries out processing of the pattern H.

Flowcharts for the processing of the patterns G and H are omitted. The pattern G differs from the pattern E in that the first direction of reciprocation is the negative Y-axis direction. The processing of the pattern G can be effected by only reversing the moving directions in Steps f1 and f7 in the processing of the pattern E shown in FIG. 15A. In a step corresponding to Step f2, moreover, the detection of the pitch position depends on whether or not the value of the Y-axis coordinate position to be moved is not greater than the value of the minimum Y-axis coordinate position of the spreading region 130. In a step corresponding to Step f8, the detection of the pitch position depends on whether or not the value of the Y-axis coordinate position to be moved is not smaller than the value of the maximum Y-axis coordinate position of the spreading region 130.

Figure 15B:
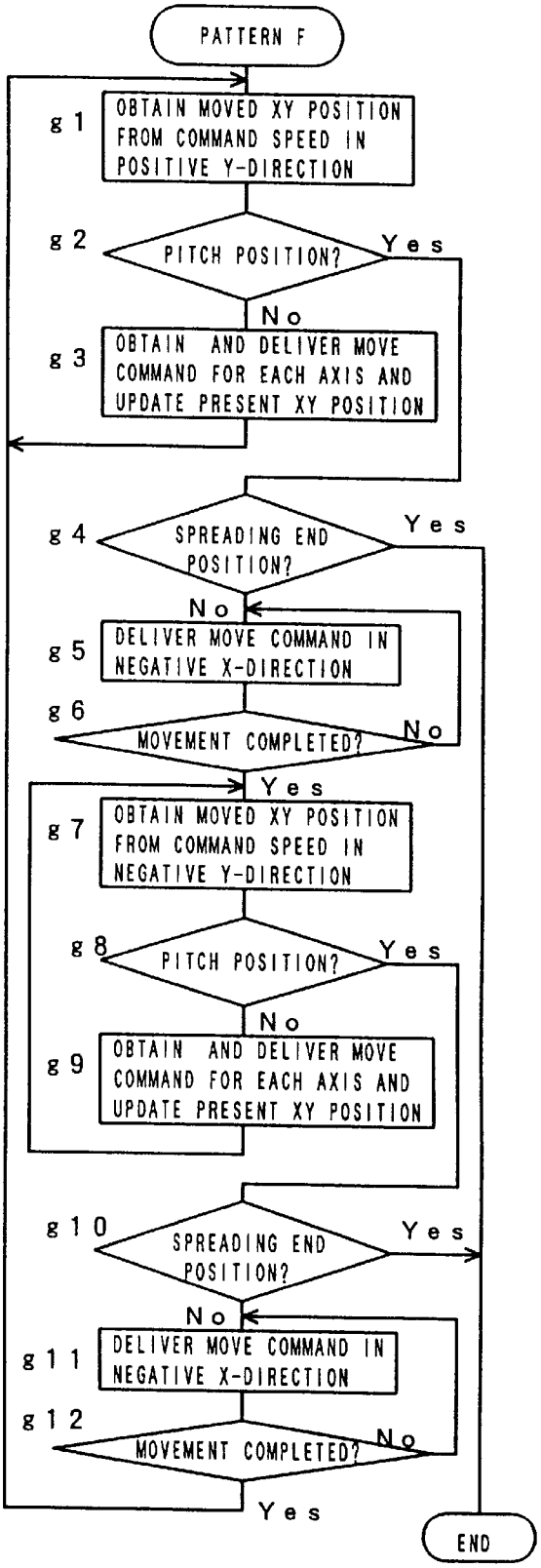
FIG. 15B is a flowchart showing processing of a pattern E executed in the automatic processing of FIG. 13.

Further, the processing of the pattern H differs from the processing of the pattern F shown in FIG. 15B in that the first moving direction is reversed to be the negative Y-axis direction. Thus, the processing of the pattern H can be effected by reversing the moving directions in Steps g1 and g7 in the processing of FIG. 15B. In a step corresponding to Step g2, moreover, the detection of the pitch position depends on whether or not the value of the Y-axis coordinate position to be moved is not greater than the value of the minimum Y-axis coordinate position of the spreading region 130. In a step corresponding to Step g8, the detection of the pitch position depends on whether or not the value of the Y-axis coordinate position to be moved is not smaller than the value of the maximum Y-axis coordinate position of the spreading region 130.

According to the present embodiment, as described above, the automatic spreading operation can be executed by selecting any one operation pattern out of the eight patterns. In executing an automatic spreading operation, some spreading patterns for spreading granule in a rectangular plane region are set in advance and any one is selected from among these patterns. Then the granule such as fresh concrete is spread over the plane region with the selected pattern up to the predetermined height.

In the case where an optional path of movement (granule dropping position path) is provided for the boom body end in spreading the granule on a desired shape, however, this path is taught to the granule transfer apparatus so that the boom body end can be moved along the instruction path to drop the granule in playback operation.

In this case, the control panel 117 is provided with instruction buttons, and the boom body end is situated on the starting point of the path by the aforementioned manual or semiautomatic operation. The respective rotational positions of the boom components, that is, the respective rotational positions of the servomotors M1 and M2, are taught and stored by depressing the instruction buttons. The boom body end is moved to the next position, and the respective rotational positions of the servomotors M1 and M2 for the reached position are taught in like manner by depressing the instruction buttons. A command for linear interpolation between the two points is inputted and stored. Thereafter, the subsequent points are successively taught and stored, and commands for linear interpolation between those points are taught. The boom body end can be moved along a circular arc between two points by teaching the starting and ending points of the circular arc and an intermediate point between them and teaching circular arc interpolation for the circular arc that passes through those three points. Thus, the points on the path are taught in succession, whether the line for the interpolation between the points is a straight line or a circular arc is ordered, and the path and operation programs are taught.

Then, the boom body end is moved along the instruction path at the set speed by giving a playback command, and the granule dropped from the boom body end is spread.

What is claimed is:

1. A granule transfer apparatus comprising:

a boom body formed of two or more connected boom components each including a granule movement section, a basal end and a distal end;

a stage holding the boom body;

a boom body supporting portion that rotatably mounts the stage;

a stage turner that turns the stage relative to the boom body supporting portion;

a granule feeder provided on the stage that delivers the granule to the basal end of the boom component situated nearest to the stage;

a pivotal connecter located between each of the two or more connected boom components that connects the basal end of one boom component to the distal end of an other boom component;

a boom turner, located between each of the two or more connected boom components, that turns the one boom component with respect to the other boom component;

a junction, located between each of the two or more connected boom components, that transfers the granule from the one boom component to the other boom component; and a controller that controls the stage turner and the boom turner, wherein the stage turner and the boom turner include a detector detecting the rotational position and speed of the stage and the boom.

2. A granule transfer apparatus according to claim 1, wherein the junction is located between an undersurface of the distal end of the one boom component and the basal end of the other boom component so that the boom components are continuous with each other, and the junction comprises:

a hole vertically penetrating the junction, wherein a distal end of a belt conveyor constituting the granule movement section of the one boom component is arranged over a basal end of a second belt conveyor constituting the granule movement section of the other boom component so that the granule falls through the hole.

3. A granule transfer apparatus according to claim 1, wherein the pivotal connector comprises:

an turntable bearing with a plurality of external teeth;

an inner ring fixed to an undersurface of the distal end of the one boom component; and an outer ring, with a plurality of external teeth, fixed to a top surface of the basal end of the other boom component, wherein the boom turner is formed by providing the distal end of the one boom component with a drive for driving a pinion in mesh with the plurality of external teeth of the outer ring.

4. A granule transfer apparatus according to claim 1, wherein the controller further comprises:

a manual input controller that accepts reversible drive commands for the stage turner and the boom turner, wherein when an input is given from the manual input controller, the stage turner or the boom turner corresponding to the input is driven.

5. A granule transfer apparatus according to claim 1, wherein the controller further comprises:

a semiautomatic input controller that moves the boom body distal end straight forward or rearward in a predetermined direction, by driving the stage turner and the boom turner so that the boom body distal end moves straight in the predetermined direction when an input is given to the semiautomatic input controller.

6. A granule transfer apparatus according to claim 1, wherein the controller further comprises:

a first semiautomatic input controller that moves the boom body distal end straight forward or rearward in a predetermined direction; and a second semiautomatic input controller for forward or rearward straight movement in a direction perpendicular to the predetermined direction, wherein the first and second semiautomatic input controllers control the boom body distal end by driving the stage turner and the boom turner so that the boom body distal end moves straight in the direction corresponding to an input direction.

7. A granule transfer apparatus according to claim 1, wherein the controller controls the stage turner and the boom turner in accordance with a set movement path for the boom body distal end.

8. A granule transfer apparatus according to claim 1, wherein the stage turner and each boom turner further comprises:

a detector detecting a rotational position and a speed of the stage or boom to be turned, wherein the controller feedback-controls the position and speed of the boom body distal end in accordance with the movement path programs and the rotational position and speed detected by the detectors.

9. A granule transfer apparatus according to claim 1, wherein the controller further comprises:

a setting controller setting a movement region, a movement path pattern, and a moving speed for the boom body end, wherein the controller controls the boom body end in accordance with the movement path pattern and moving speed set by the setting controller so that the boom body distal end moves with the movement path pattern at the moving speed in the movement region.

10. A granule transfer apparatus according to claim 9, wherein the controller feedback-controls the boom body end in accordance with a movement path pattern and a moving speed set by the controller and the positions and speeds detected by the detector so that the boom body end moves with the movement path pattern at the moving speed in the movement region.

11. A granule transfer apparatus according to claim 9, wherein the movement path pattern of the boom body distal end is set in accordance with a direction of reciprocation and a pitch value for a deflection of a path caused as the moving direction is reversed.

12. A granule transfer apparatus according to claim 11, wherein the controller further comprises:

a memory that stores a plurality of directions of reciprocation, wherein the setting controller sets the plurality of directions by selecting one of the stored directions of reciprocation.

13. A granule transfer apparatus according to claim 11, wherein the setting controller sets the pitch direction and the pitch value.

14. A granule transfer apparatus according to claim 1, wherein the boom body supporting portion further comprises:

a tower mast fixed on a ground, the tower mast comprising a granule lifter that lifts the granule from a bottom part of the boom body supporting portion to the granule feeder on the stage.

15. A granule transfer apparatus according to claim 1, wherein the boom body supporting portion is fixed to a traveling body.

16. A granule transfer apparatus according to claim 1, wherein the stage turner and each boom turner are provided with a motor as a drive source.

17. A granule transfer apparatus according to claim 15 further comprising: a boom body tilt angle adjuster, wherein the basal end of a first boom component is rockably mounted on the stage, the distal end of the first boom component is bent and connected with a second boom component, and a tilt angle of the boom body can be adjusted by the boom body tilt angle adjuster.

18. In a granule spreading method using a granule transfer apparatus, which comprises a boom body supporting portion for rotatably mounting a stage having thereon a boom body formed of two or more connected boom components each including transfer means for transferring granule, stage turning means for turning said stage relative to the boom body supporting portion, granule delivery means provided on said stage and serving to deliver the granule to said transfer means of the boom component situated nearest to the stage, junction granule delivery means for delivering the granule from the transfer means of the boom component to the transfer means of the next boom component, a pivotal portion located between the boom components and serving to connect the distal end portion of the boom component on the stage side and the basal part of the next boom component, boom turning means for turning the next boom component with respect to the stage-side boom component, detectors for detecting the rotational positions and speeds of the stage or boom to be turned by said stage turning means and each boom turning means, and a controller for feedback-controlling the position and speed of said boom body end in accordance with the positions and speeds detected by the detectors, said granule spreading method comprising:

previously teaching an operational movement program to order the position of the boom body end and a rectilinear or arcuate movement between positions, and causing said controller to drive said transfer means to move said boom body end along a movement path given by the taught program and spread the granule while throwing out the granule through the boom body end, in accordance with the taught program.

19. In a granule spreading method using a granule transfer apparatus, which comprises a boom body supporting portion for rotatably mounting a stage having thereon a boom body formed of two or more connected boom components each including transfer means for transferring granule, stage turning means for turning said stage relative to the boom body supporting portion, granule delivery means provided on said stage and serving to deliver the granule to said transfer means of the boom component situated nearest to the stage, junction granule delivery means for delivering the granule from the transfer means of the boom component to the transfer means of the next boom component, a pivotal portion located between the boom components and serving to connect the distal end portion of the boom component on the stage side and the basal part of the next boom component, boom turning means for turning the next boom component with respect to the stage-side boom component, detectors for detecting the rotational positions and speeds of the stage or boom to be turned by said stage turning means and each boom turning means, and control means for feedback-controlling the position and speed of said boom body end in accordance with the positions and speeds detected by the detectors, said granule spreading method comprising:

previously causing said control means to set and store a movement pattern for said boom body end, setting a granule spreading region as an input in said control means to move said boom body end into said granule spreading region, and then driving said transfer means to move said boom body end in said set granule spreading region, thereby automatically spreading the granule, in accordance with said set movement pattern, while throwing out the granule through the boom body end.

* * * * *